US005860899A

United States Patent [19]

Rassman

[11] Patent Number: 5,860,899

[45] Date of Patent: Jan. 19, 1999

[54] BACK MANIPULATING APPARATUS

[75] Inventor: William R. Rassman, Los Angeles, Calif.

[73] Assignee: New Back Technologies, L.L.C., Los Angeles, Calif.

[21] Appl. No.: 729,720

[22] Filed: Oct. 7, 1996

[51] Int. Cl.[6] ..... A63B 23/02

[52] U.S. Cl. ..... 482/142; 482/56; 482/131; 601/24; 601/90; 606/242; 606/244; 5/607; 5/609

[58] Field of Search ..... 601/5, 23, 24, 601/26, 33, 34, 35, 86, 90, 98; 606/241–245; 482/55, 56, 131, 142, 907; 5/607–610, 613, 614, 618

[56] References Cited

U.S. PATENT DOCUMENTS

| | | | |
|---|---|---|---|
| 1,602,196 | 10/1926 | Iverson et al. | 601/26 |
| 1,686,979 | 10/1928 | McManis | 601/24 |
| 1,966,448 | 7/1934 | Kabisius . | |
| 2,109,725 | 3/1938 | Hudson | 482/56 |
| 2,332,184 | 10/1943 | Sweeney | 601/26 |
| 3,731,921 | 5/1973 | Andrews, Jr. . | |
| 4,674,740 | 6/1987 | Iams et al. . | |
| 4,684,126 | 8/1987 | Dalebout et al. . | |
| 4,732,141 | 3/1988 | SteFFensmeier | 606/242 |
| 4,936,572 | 6/1990 | DesiderIo | 482/142 |
| 4,948,119 | 8/1990 | Robertson, Jr. . | |
| 5,125,884 | 6/1992 | Weber et al. . | |
| 5,158,513 | 10/1992 | Reeves . | |
| 5,163,890 | 11/1992 | Perry, Jr. | 482/142 |
| 5,192,304 | 3/1993 | Rassman . | |
| 5,376,060 | 12/1994 | Murray | 482/142 |
| 5,393,280 | 2/1995 | Haviv . | |
| 5,462,509 | 10/1995 | Lister | 482/142 |
| 5,484,151 | 1/1996 | Tholkes . | |
| 5,628,632 | 5/1997 | Doane | 482/56 |

FOREIGN PATENT DOCUMENTS

| | | |
|---|---|---|
| 1680238 | 9/1991 | U.S.S.R. . |
| 2118849 | 11/1983 | United Kingdom . |

*Primary Examiner*—Jeanne M. Clark
*Attorney, Agent, or Firm*—Fitzpatrick, Cella, Harper & Scinto

[57] ABSTRACT

An apparatus for manipulating a user's back while supporting the user's back and hips includes a support defining a longitudinal axis, and a seat pad disposed along the support at a position corresponding to the user's hips for supporting the user's hips. The seat pad is rotatable around the longitudinal axis and has an attached seat belt for holding a user on the seat pad. A pair of handles are provided, one on each side of the seat pad, which are coupled to the seat pad and which are movable in reciprocal back-and-forth motion to control rotation of the seat pad around the longitudinal axis. A resistance device is coupled to the seat pad or elsewhere for providing resistance to reciprocal back-and-forth motion of the handles, and two mechanical stops are provided, one on each side of the apparatus, for limiting rotation of the seat pad. The mechanical stops each have plural settings for adjusting a maximum angle of rotation of the seat pad. The apparatus also includes a back pad coupled to the support, which is adjustable along the longitudinal axis.

30 Claims, 14 Drawing Sheets

BACK MANIPULATING APPARATUS

BACKGROUND OF THE INVENTION

1. Field Of The Invention

The present invention relates to an apparatus for manipulating components of a user's back, such as muscles, joints, bones, tendons, ligaments, etc., which provides a rotatable seat pad for holding a user's pelvis and a pair of handles for controlling rotation of the seat pad such that the user's pelvis and the user's back are rotated relative to each other.

2. Description Of The Related Art

Lower back pain plagues a large percentage of the adult population. As is generally known, swimming is an excellent exercise for reducing many types of lower back pain. That is, the pelvic rotation produced during swimming causes movement in the swimmer's back (including, but not limited to, the muscles, joints, bones, tendons and ligaments) which often relieves lower back pain.

Although swimming is an excellent exercise for relieving lower back pain, many of those who suffer from lower back pain are unable to swim on a regular basis due to, for example, physical, financial or climatic restraints. Accordingly, swimming machines, such as that described in U.S. Pat. No. 5,158,513, have been developed to provide an exercise alternative to swimming which most people can do regularly.

Conventional swimming machines, however, suffer from a drawback that is also inherent in swimming. specifically, conventional swimming machines allow free pivoting of the pelvis and do not allow control over the degree of pelvic rotation. As a result, conventional swimming machines may cause pelvic under-rotation, which can diminish the therapeutic effect of the exercise, or pelvic over-rotation, which can harm the user's back even further.

Accordingly, there exists a need for an apparatus which manipulates a user's back by rotating the user's pelvis in a manner similar to that of swimming, and which provides a way for the user to control that rotation.

SUMMARY OF THE INVENTION

The present invention addresses the foregoing need by providing an apparatus for manipulating features of a user's back, e.g., the muscles, joints, bones, tendons, ligaments, etc. The apparatus includes a pair of upwardly extending handles, one on each side of the apparatus, which are coupled (mechanically or otherwise) to a rotatable seat pad for holding a user's pelvis. The pair of handles, which are grasped by the user while reclining on the apparatus, move in reciprocal back-and-forth motion to control rotation of the seat pad, and thus the user's pelvis, about a longitudinal axis. The remainder of the user's back remains substantially immobile. By virtue of this controlled pelvic rotation, the user's back is manipulated in a controlled way, thereby providing a therapeutic effect without a substantial risk of pelvic over-rotation or under-rotation. (As noted below, additional rotation can be achieved through pelvic motion produced by the user himself.)

Thus, according to one aspect, the present invention is an apparatus for manipulating a user's back while supporting the user's back and hips. The apparatus includes one or more pads arranged along a longitudinal axis, the one or more pads for supporting the user's back and hips, and being rotatable around the longitudinal axis. A pair of handles are provided, one on each side of the apparatus, along with a pair of couplings. One of the pair of couplings is disposed between each of the pair of handles and at least one of the one or more pads. In addition, the couplings are responsive to reciprocal back-and-forth motion of the handles to control rotation of the one or more pads around the longitudinal axis.

According to another aspect, the present invention is an apparatus for manipulating back muscles while supporting a user's back and hips. The apparatus includes first and second pads, i.e., back and seat pads, respectively, arranged along a longitudinal axis. The first pad supports the user's back and the second pad supports the user's hips. The first and second pads are mutually rotatable around the longitudinal axis. Also included in the apparatus are a pair of handles, one on each side of the apparatus, and a pair of couplings, one between each of the pair of handles and at least one of the first pad and the second pad. The couplings are responsive to reciprocal back-and-forth motion of the handles to control mutual rotation of the first pad and the second pad around the longitudinal axis.

In a preferred embodiment of the invention, each coupling is a mechanical coupling that comprises a rotatable arm coupled between each handle and a side of the seat pad. In such embodiments, a rotatable arm moves downward in response to a forward motion of a handle so as to cause the seat pad to rotate downward, and moves upward in response to a backward motion of the handle so as to cause the seat pad to rotate upward. By virtue of this configuration, it is possible to control angular motion of the seat pad via the handles. Additional pelvic rotation can be achieved through pelvic rotation resulting from muscle movement produced by the user.

In particularly preferred embodiments, each handle comprises an upwardly extending lever for manual activation, a base which extends outwardly from a bottom of the lever, and a finger which extends inwardly from an end of the base. Each rotatable arm includes a head at each end thereof, which has a throughbore. In such embodiments, each mechanical coupling also includes a plate affixed to an underside of the seat pad. The plate has a member extending outwardly therefrom on each side of the longitudinal axis, such that each rotatable arm is coupled between the plate and a handle by (1) inserting a head of the rotatable arm onto the member extending from the plate and (2) placing the other head of the rotatable arm on a finger on the rotatable arm. The head of the rotatable arm inserted onto the member is rotatable around the member; and the head of the rotatable arm inserted onto the finger is rotatable around the finger.

In other preferred embodiments of the invention, a resistance device, such as a variable resistance air cylinder, friction pads, etc., is mechanically coupled to the seat pad so as to provide resistance to the reciprocal back-and-forth motion of the handles. This feature provides an added advantage to the invention in that the additional resistance promotes the development of muscle tissue in the user's arms, back, abdominals, and other major muscle groups. In particularly preferred embodiments of the invention, the resistance device is settable to provide different levels of resistance to accommodate different users.

As an alternative to the foregoing configuration, other embodiments of the invention include one or more resistance devices, such as friction pads, coupled to each of the pair of handles. Like the resistance device described above, the one or more resistance devices provide resistance to the back and forth motion of the handles for the purpose of building muscles.

In still other preferred embodiments of the invention, at least one of the back pad and the seat pad is adjustable such that the back pad and the seat pad can be positioned at different points along the longitudinal axis relative to one another. This feature of the invention enables users of different heights to use the apparatus comfortably.

Some preferred embodiments of the invention include mechanical stops, preferably one on each side of the seat pad, to limit angular motion of the seat pad around the longitudinal axis. Preferably, the mechanical stops are settable to various angles, thereby giving the user options as to a desired maximum angle of pelvic rotation. In a case where the back pad is rotatable, identical mechanical stops are provided on the back pad so as to limit its rotation in the same manner as that of the seat pad.

In particularly preferred embodiments, the mechanical stops comprise two metal plates, a pin and a stopper. The stopper is rotatable through the metal plates and the metal plates have corresponding holes for receiving the pin. When the pin is received in corresponding holes of the metal plates, the stopper is prevented from rotating.

In further preferred embodiments of the invention, the longitudinal axis is defined by a linear support, which can be inclined at an angle. This feature of the invention facilitates use of the apparatus by those persons with severe back pain. More specifically, it is generally difficult for people with severe back pain, and even for some people with mild back pain, to bend over. As a result, it is difficult for such people to get onto a horizontal apparatus. However, because the linear support of the present apparatus can be inclined at an angle and subsequently declined back to its original horizontal position, even a user who has difficultly bending over can easily position himself on the apparatus, operate the apparatus in a horizontal position, and dismount the apparatus.

Accordingly, in the foregoing preferred embodiments, the apparatus also includes a controlling mechanism for inclining the linear support of the apparatus and all elements disposed thereon along a range of angles. The controlling mechanism in such embodiments can be electrical, although hydraulic or mechanical control devices can be used.

In particularly preferred embodiments, the apparatus includes a locking mechanism for locking the seat pad at a predetermined angle so as to prevent rotation of the seat pad. This feature facilitates mounting of the apparatus in that, since the seat pad is locked, it cannot rotate during mounting. Preferably, the locking mechanism includes a fastening plate for fastening the locking mechanism to the apparatus along the longitudinal axis, the fastening plate having a hole therethrough, and plural plates rotatably mounted below the seat pad and rotatable about a pivot point relative to the seat pad. The plural plates (1) are interconnected to rotate in unison and (2) are rotatable through the fastening plate, at least one of the plural plates having a hole therethrough which aligns with the hole in the fastening plate. A pin is provided for inserting into the hole of the at least one plural plate and into the hole of the fastening plate for holding the plural plates at a predetermined angle relative to the seat pad. It should be noted, however, that other locking mechanisms can be employed in the foregoing.

In other embodiments, the seat pad includes upper and lower portions defined by a lateral axis which is roughly perpendicular to the longitudinal axis. In these embodiments, the upper and lower portions are preferably connected via a hinge. Such a feature permits the upper and lower portions of the seat pad to be angled relative to one another, thereby accommodating persons with different back shapes.

In still other preferred embodiments, the seat pad is settable to one of various pitch angles along a lateral axis which is roughly perpendicular to the longitudinal axis. Preferably, the configuration for setting the pitch angles uses mechanical rockers for rotating the seat pad throughout plural pitch angles and a pitch angle stop for holding the seat pad at a particular pitch angle.

The apparatus can also include a pair of stationary handles which extend downwardly from the back pad. In an alternative operation of the apparatus, these handles can be grasped by a user on the apparatus. In that operation, the user can rotate his hips through muscular motion, as noted above, thereby causing the seat pad to rotate without using the pair of handles. Alternatively, the apparatus can comprise a single handle fixed to the back pad which wraps around the back pad. In preferred embodiments, the height of this handle is adjustable relative to the back pad so as to accommodate users having different arm lengths.

In an alternative embodiment, the coupling comprises a monitor for monitoring a rate of rotation of the seat pad in order to determine whether the rate of rotation exceeds a preset limit, and a rotation controller for controlling the rate of rotation of the seat pad to the preset limit in a case that the monitor determines that the rate of rotation exceeds the preset limit. By monitoring angular rotation of the seat pad in order to determine when it exceeds a preset limit, and by controlling the rotation of the seat pad to the preset limit when the rate of rotation exceeds the preset limit, this aspect of the invention is able to reduce back injuries caused by an overly rapid rotation of the seat pad.

Preferably, the above aspect of the invention includes adjusting means for adjusting the preset limit of the rate of the rotation of the seat pad. By virtue of this feature, a user is able to adjust the preset limit to accommodate the user's needs.

In the above embodiment, preferably, the rotation controller includes a fly wheel assembly, connected between the pair of handles and the seat pad, which spins in accordance with the back-and-forth motion of the pair of handles in order to rotate the seat pad. The monitor monitors the fly wheel assembly in order to determine whether the rate of rotation of the seat pad exceeds the preset limit. The rotation controller generally comprises a clutch, connected between the pair of handles and the fly wheel assembly, which engages in a case where the rate of rotation of the seat pad exceeds the preset limit so as to disconnect the pair of handles from the fly wheel assembly, and which disengages in a case where the rate of rotation of the seat pad is less than or equal to the preset limit so as to connect the pair of handles to the fly wheel assembly. Also provided are a gear reduction box which steps-down a rate of spinning of the fly wheel assembly, a rotatable member, which rotates at the rate of spinning stepped-down by the gear reduction box, and a motion converter which converts rotation of the rotatable member to a push-pull motion. A linking rod, which is coupled between the motion converter and the seat pad, rotates the seat pad in accordance with the push-pull motion of the motion converter. In this aspect of the invention, the monitor causes the clutch to engage and to disengage based on a monitored rate of rotation of the seat pad.

By virtue of the foregoing configuration, control over the rotation rate of the seat pad about the longitudinal axis can be achieved without great complexity or cost.

According to another aspect, the present invention is an apparatus for manipulating back muscles while supporting a user's back and hips, which includes a linear support disposed along a longitudinal axis and a seat pad disposed along the linear support. The seat pad is rotatable around the longitudinal axis and has an attached seat belt for holding a user thereon. The apparatus also includes a pair of handles, one on each side of the seat pad, which are mechanically coupled to the seat pad and which are movable in reciprocal back-and-forth motion to control rotation of the seat pad around the longitudinal axis, and a resistance device coupled to the seat pad (or, in alternate embodiments, coupled to the handles) for providing resistance to the reciprocal back-and-forth motion of the handles. Two mechanical stops, one on each side of the apparatus, are provided to limit the angle of rotation of the seat pad. Each of the mechanical stops has plural settings for adjusting a maximum angle of rotation of the seat pad. A back pad is coupled to the linear support and is adjustable along the longitudinal axis. Mechanical couplings similar to those described above are provided to couple the handles to the seat pad.

In addition, the foregoing apparatus can include handles on the back pad which extend downwardly therefrom, and which can be gripped by a user on the apparatus. A single handle such as that described above can also be used.

The foregoing aspect of the invention combines many of the advantages and features described above into one apparatus. Accordingly, a detailed description of specific advantages thereof is omitted for the sake of brevity.

This brief summary has been provided so that the nature of the invention may be understood quickly. A more complete understanding of the invention can be obtained by reference to the following detailed description of the preferred embodiments thereof in connection with the attached drawings.

DETAILED DESCRIPTION OF THE PREFERRED EMBODIMENTS

In brief, the present invention is an apparatus for manipulating a user's back (including the muscles, joints, bones, tendons, ligaments, etc. thereof) while supporting the user's back and hips. The apparatus includes first and second pads (i.e., back and seat pads, respectively) arranged along a longitudinal axis. The first pad supports the user's back and the second pad supports the user's hips. The first and second pads are mutually rotatable around the longitudinal axis. Also included in the apparatus are a pair of handles, one on each side of the apparatus, and a pair of mechanical couplings, one between each of the pair of handles and at least one of the first pad and the second pad. The mechanical couplings are responsive to reciprocal back-and-forth motion of the handles to control mutual rotation of the first pad and the second pad around the longitudinal axis.

Figure 1:
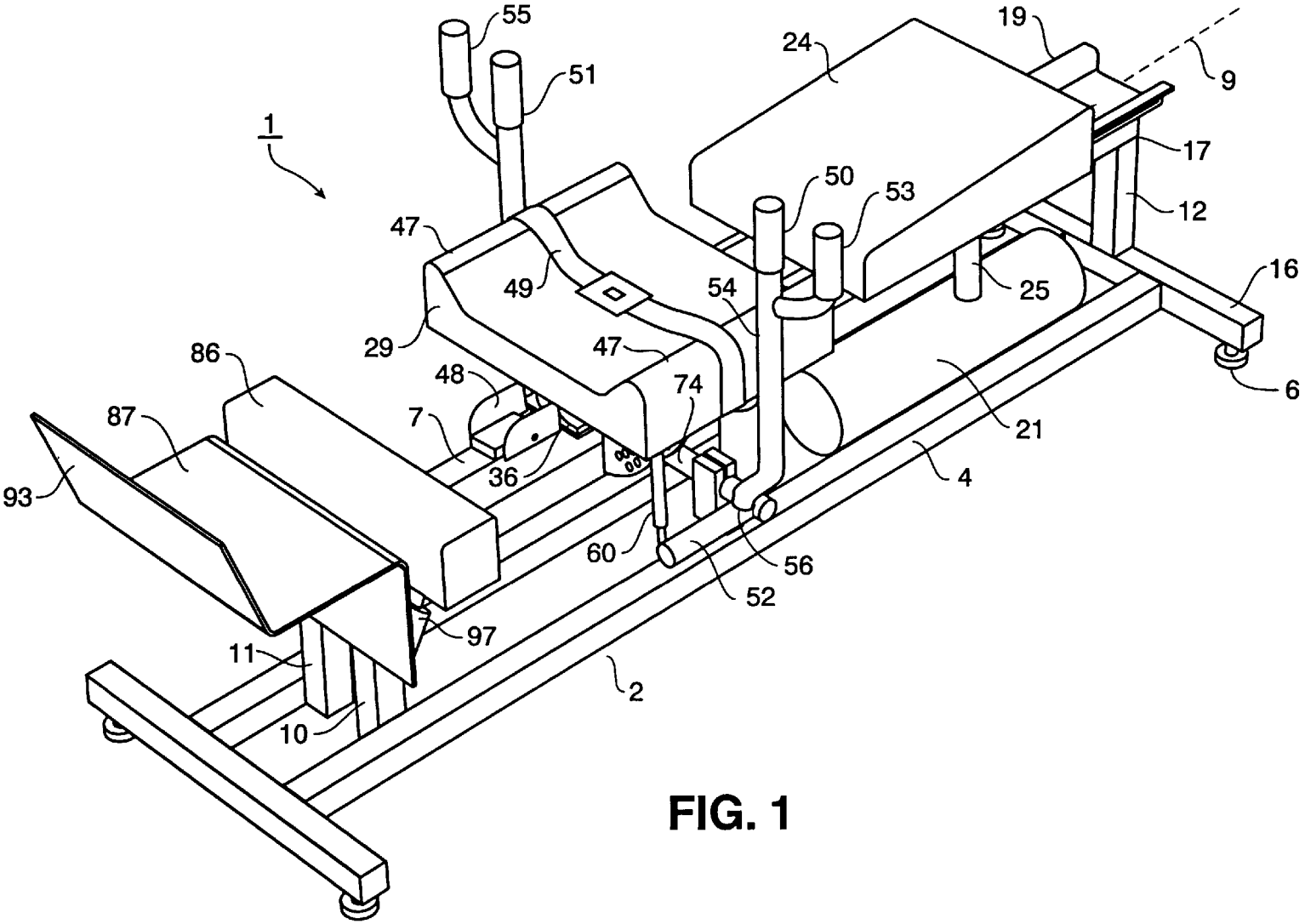
FIG. 1 shows a perspective view of a preferred embodiment of the back manipulating apparatus of the present invention.
Figure 2:
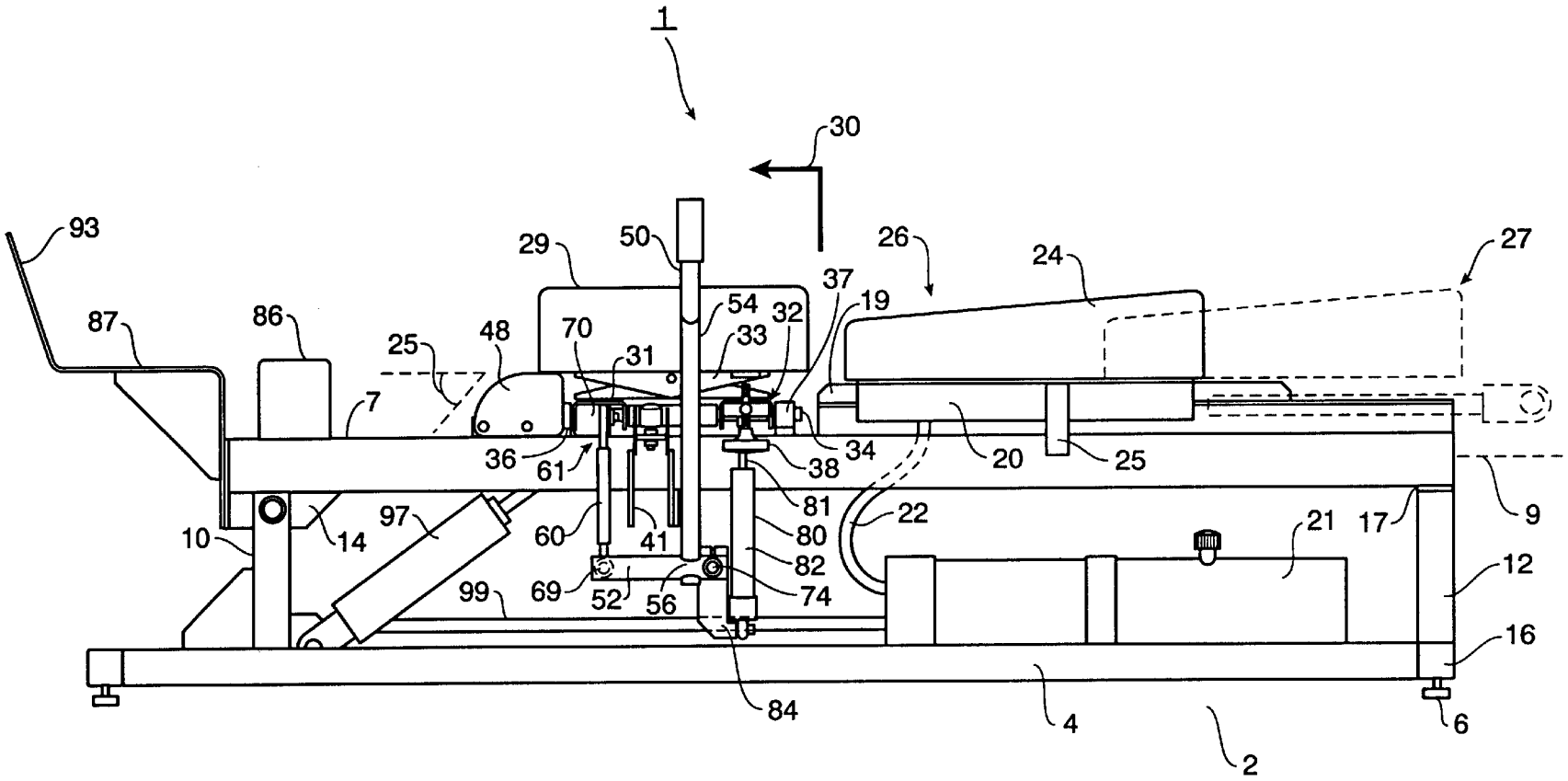
FIG. 2 shows a side view of the apparatus of FIG. 1.

FIG. 1 shows a perspective view of a representative embodiment of foregoing back manipulating apparatus 1, and FIG. 2 is a side view thereof. As shown in FIGS. 1 and 2, apparatus 1 includes frame 2, made of any sufficiently strong material, preferably of metal such as steel, and base 4 which supports apparatus 1. As shown in FIG. 1, base 4 is preferably rectangular and is comprised of two sets of parallel beams which intersect at right angles. The parallel beams of base 4 can include pads 6 on their undersides, which are used to support apparatus 1. Preferably, pads 6 are made of rubber or malleable plastic. Such pads are used to reduce slipping of apparatus 1 on hard or slippery surfaces.

The dimensions of base 4 can be set as desired. However, in preferred embodiments, base 4 is roughly 1.8 meters (6 feet) by 0.7 meters (28 inches).

Frame 2 also includes (1) linear support 7, which runs roughly parallel to the plane defined by base 4 and along longitudinal axis 9, and (2) foot bars 10 and 11 and head bar 12, which run roughly perpendicular to the plane defined by base 4. Foot bars 10 and 11 and head bar 12 interface base 4 to support 7. More specifically, as shown in FIG. 1, foot bars 10 and 11 are disposed between parallel beams of base 4, and are fixed thereto. Foot bars 10 and 11, in an alternative embodiment, can also be positioned outside of the parallel beams of base 4. Support 7 is disposed between foot bars 10 and 11, and includes tabs, such as tab 14 shown in FIG. 2, which are pivotally connected to foot bars 10 and 11. This feature of the invention will be described in more detail below.

Head bar 12, on the other hand, is disposed roughly in the center of beam 16 of base 4, and is fixed thereto. Head bar 12 includes a cross-sectional top surface (not shown), which connects with the underside of support 7 at point 17. To this end, the cross-sectional top surface of head bar 12 and the underside of support 7 preferably have compatible surfaces. Head bar 12 and support 7, however, are not fixed to each other. Rather, support 7 merely rests on top of head bar 12. Such a configuration permits support 7 to pivot at an angle with respect to base 4. That is, since support 7 is not fixed to head bar 12, support 7 can be pivoted with respect to base 4 about foot bars 10 and 11.

As was the case above with respect to base 4, foot bars 10 and 11 and head bar 12 can be any desired length. However, for the representative embodiment described herein, each of these bars is roughly 0.2 meters (9 inches) long, and is arranged so that support 7, in an uninclined position, is roughly parallel to the plane of base 4.

Tracks 19, shown in FIGS. 1 and 2, are fixed to the top of support 7. Conveyor 20, shown in FIG. 2, is slidably fit within tracks 19 such that conveyor 20 is movable along the entire length of tracks 19. In this regard, the length of tracks 19 can be set as desired; however, in the preferred embodiment described herein, tracks 19 extend roughly 0.9 meters (35 inches) from head bar 12 towards foot bars 10 and 11.

Back pad 24 is connected to conveyor 20 via screws, or the like, (not shown), such that back pad 24 is movable along with conveyor 20. By virtue of this configuration, back pad 24 is adjustable along support 7. That is, a user can adjust back pad 24 to position 26, position 27 or anywhere in between by moving conveyor 20 along tracks 19 on support 7. This feature is provided so that people of various heights will feel comfortable when using apparatus 1.

The motion of back pad 24 and conveyor 20 along tracks 19 preferably can be controlled via hydraulics, which are provided with hydraulic fluid from hydraulic tank 21 via hydraulic line 22. However, such a feature is not essential to the present invention. More specifically, simple manual or electrical control over the motion of back pad 24 and conveyor 20 is also possible. For example, a crank system or an electrical motor could be used to move back pad 24 and conveyor 20 along tracks 19. Additionally, back pad 24 could be screwed and unscrewed into different positions along support 7.

As shown in FIGS. 1 and 2, back pad 24 is preferably flat, made from vinyl, and cushioned to a degree sufficient to ensure comfort without sacrificing back support. It is noted, however, that back pad 24 may be contoured, or formed in any other shape, so as accommodate a user comfortably. In addition, back pad 24 may include raised edges, such as those described below with respect to seat pad 29. These features are particularly advantageous in embodiments of the invention in which back pad 24 rotates about longitudinal axis 9 since they reduce the chances that a user will fall off back pad 24 during rotation.

Additionally, in preferred embodiments, back pad 24 includes a neck support (not shown), which is raised at the neck area to support the neck of a user on the apparatus. Preferably, the neck support is adjustable along back pad 24. Such adjustability can be provided via a number of means, e.g., snaps on the back pad or the like. In addition, one stationary handle, such as stationary handle 25 shown in the figures, is provided on each side of back pad 24 and extends downwardly therefrom. Such handles may be grasped by a user lying on apparatus 1 in a case where the user wishes to control rotation of seat pad 29 solely through back motion rather than via handles 50 and 51 described below. Alternatively, the apparatus can comprise a single handle fixed to the back pad which wraps around the back pad. In preferred embodiments, the height of this handle is adjustable relative to the back pad so as to accommodate users having different arm lengths.

Figure 16:
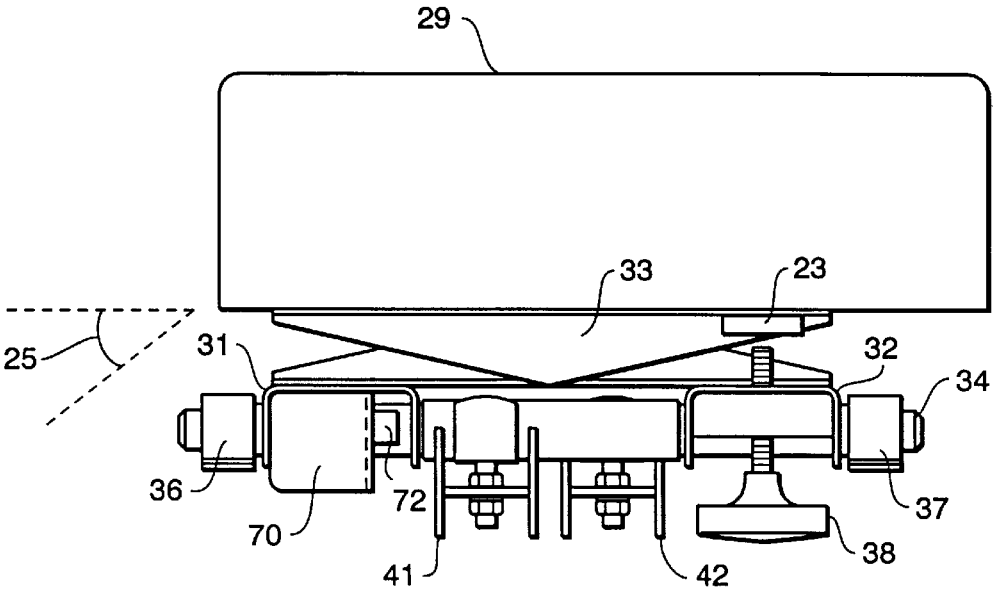
FIGS. 16 and 17 show close-up side and back views, respectively, of the seat pad of FIGS. 3 and 4.
Figure 17:
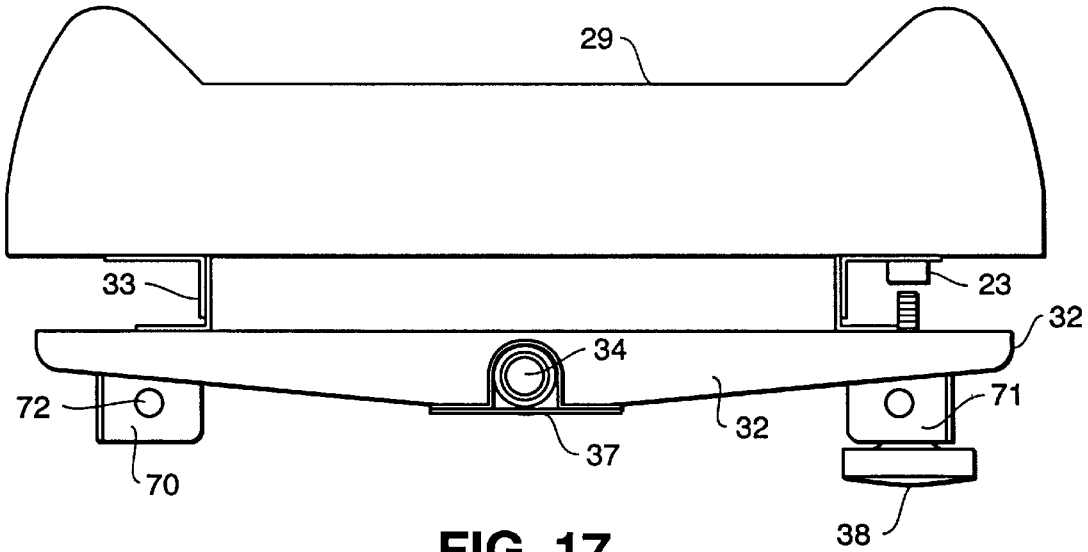

Also connected to support 7 is seat pad 29, close-up views of which are shown in FIGS. 16 and 17. Seat pad 29 and back pad 24 are mutually and controllably rotatable around longitudinal axis 9, and in this embodiment seat pad 29 is rotatable and back pad 24 is not. It is noted that in those embodiments of the apparatus in which back pad 24 is rotatable, rotation thereof can be effected in a manner identical to that described herein for seat pad 29.

The connection of seat pad 29 to support 7 will be described first, followed by the structure of seat pad 29. These descriptions are provided with respect to FIGS. 2, 16 and 17, and to FIGS. 3 and 4, which depict back views of apparatus 1 taken along line 30 shown in FIG. 2.

As shown in the figures, seat pad 29 is connected to support 7 via plates 31 and 32 (or the like), rockers 33, rotation cylinder 34, and clamps 36 and 37. More specifically, as shown in the figures, clamps 36 and 37 clamp rotation cylinder 34 to support 7 so that rotation cylinder 34 is parallel to, and above the surface of, support 7. Plates 31 and 32 are connected to rotation cylinder 34 via throughbores (not shown) in plates 31 and 32. By virtue of this configuration, plates 31 and 32 can be freely rotated about rotation cylinder 34, and thus support 7, as shown in the figures.

As shown, seat pad 29 itself is connected to plates 31 and 32 via rockers 33. Rockers 33 permit seat pad 29 to rotate through plural pitch angles along lateral axis 35, shown in FIG. 3, which is roughly perpendicular to longitudinal axis 9. Also provided on apparatus 1 is adjusting mechanism 38, shown in detail in FIGS. 16 and 17, which is preferably threaded through a hole in one of plates 31 and 32, and which permits setting of a pitch angle (e.g., angle 25, shown in FIGS. 2 and 16) for seat pad 29. More specifically, adjusting mechanism 38 screws up towards seat pad 29 and mates to mating portion 23, thereby causing rockers 33 to rock seat pad 29 to a desired pitch angle. Mating portion 23 is used to fasten seat pad 29 to adjusting mechanism 38 and thereby to hold seat pad 29 at a particular pitch angle. In this manner, seat pad 29 can be set to one of a range of pitch angles. Such pitch angles accommodate different spine curvatures of different users better than seat pads having a constant 0° pitch angle.

Figure 5:
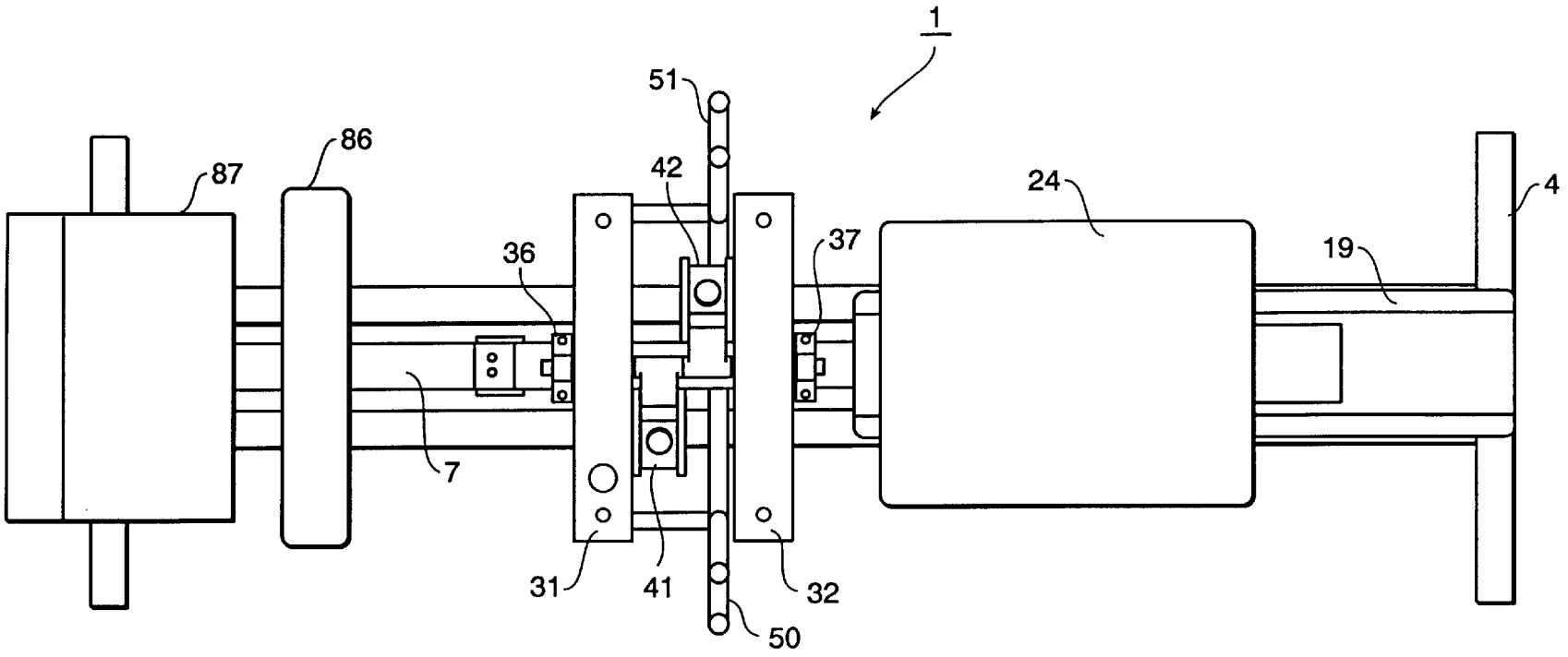
FIG. 5 shows a top view of the apparatus of FIG. 1 with the seat pad and rockers removed.

FIG. 5, which depicts a top view of apparatus 1 with seat pad 29 and rockers 33 removed, shows a top view of plates 31 and 32. Plates 31 and 32 receive rockers 33, which are fixed thereto via screws or the like (not shown), such that seat pad 29 is both rotatable about support 7 and settable to plural pitch angles about lateral axis 35.

Figure 3:
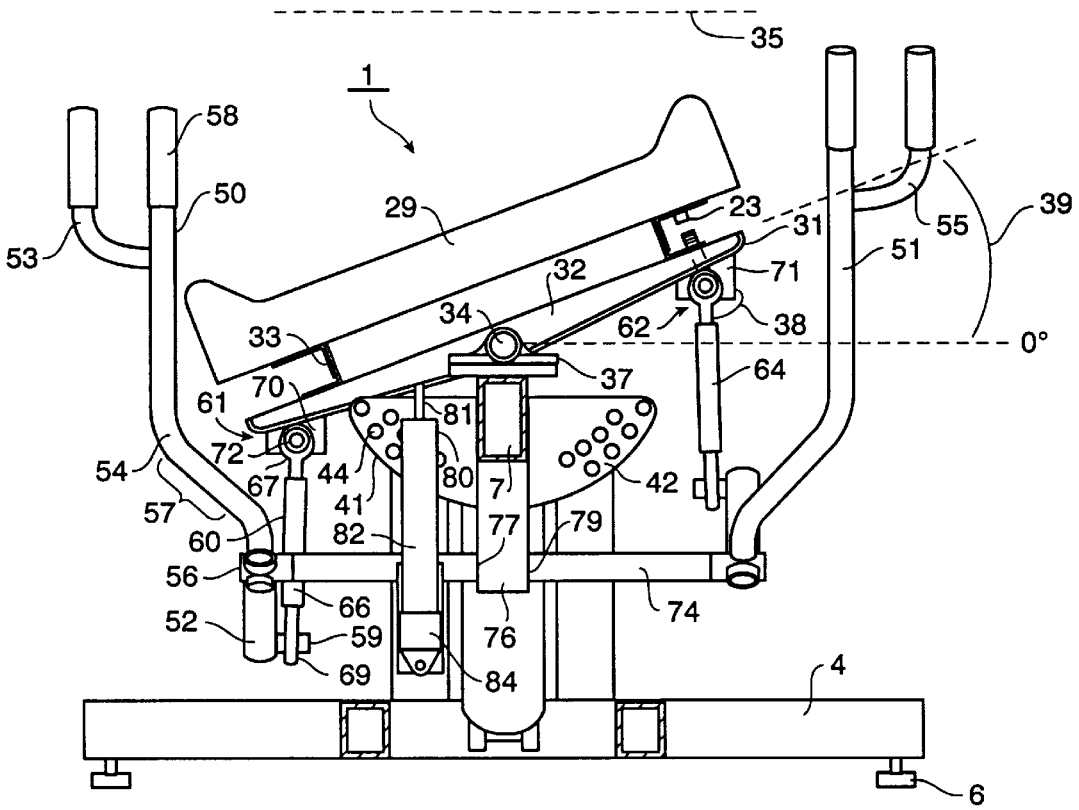
FIGS. 3 and 4 show back views depicting rotation of a seat pad used in the apparatus of FIG. 1.
Figure 4:
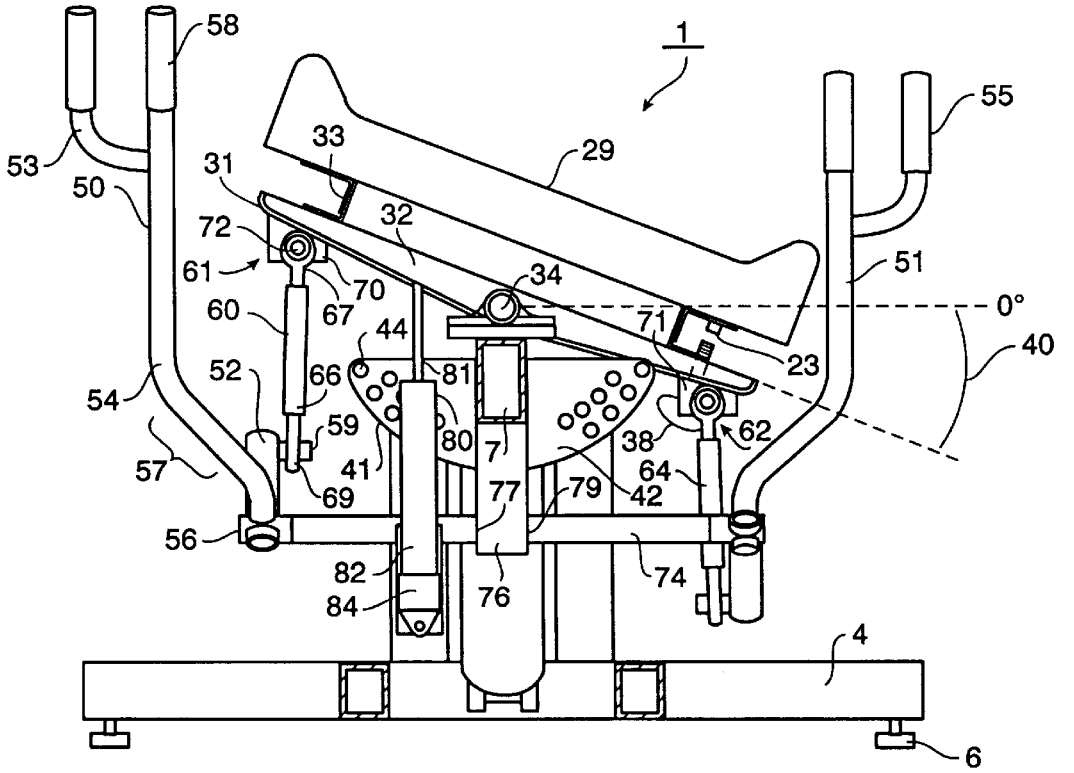

With regard to rotation about support 7, as shown in FIGS. 3 and 4, seat pad 29 is rotatable throughout a range of angles about support 7. The angles of rotation of seat pad 29 are depicted as angles 39 and 40 in FIGS. 3 and 4, respectively. In this regard, in preferred embodiments of apparatus 1, angles 39 and 40 are each a maximum of 330. To this end, apparatus 1 is provided with mechanical stops 41 and 42 to limit the angular rotation of seat pad 29 around support 7. Of course, since angular rotation is controlled via handles 50 and 51, rotation of seat pad 29 can also be limited by limiting the amount of back-and-forth motion provided to the handles.

Figure 6:
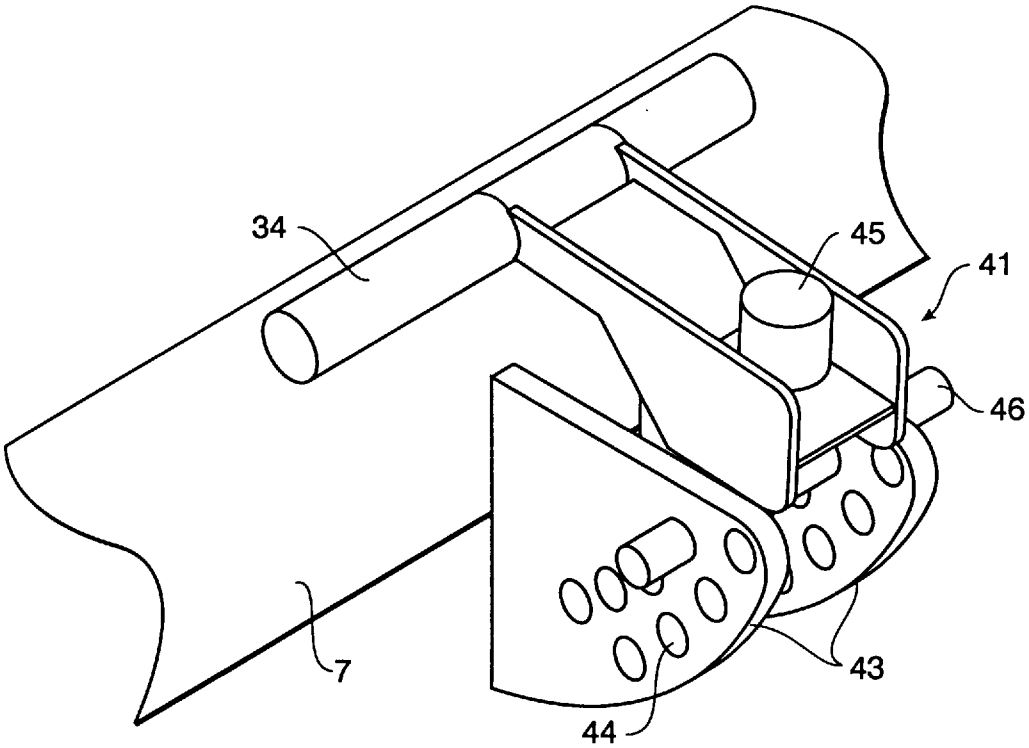
FIG. 6 shows a close-up view of a mechanical stop used in the apparatus of FIG. 1.

FIGS. 3 and 4 show close-up views of mechanical stops 41 and 42, and FIGS. 5 and 6 show top and perspective views, respectively, of mechanical stops 41 and 42 taken with seat pad 29 and rockers 33 removed. As shown in FIGS. 3, 4 and 6, mechanical stop 41 (which is identical to mechanical stop 42) includes two metal plates 43 having holes 44, stopper 45 and pin 46. Stopper 45 is rotatable through metal plates 43. However, when pin 46 is inserted into corresponding ones of holes 43, rotation of stopper 45 is prevented. In this manner, mechanical stop 41 is set to a particular angle. More specifically, pin 46 is inserted into corresponding ones of holes 44 so as to support stopper 45 at a particular angle, as shown in FIG. 6. Stopper 45 thus prevents seat pad 29 from rotating beyond its set angle.

In this regard, mechanical stop 41 preferably has holes formed at positions which can be used to limit the motion of seat pad 29 to one of 0°, 5°, 10°, 15°, 20°, 25°, 30° and 33° (the preferred maximum angle of rotation). Additional holes can be provided as desired to vary further the rotational angle of seat pad 29 relative to longitudinal axis 9. As noted above, by limiting the maximum angle of rotation of seat pad 29, it is possible to reduce occurrences of pelvic over-rotation.

Additionally, as shown in FIGS. 1 and 2, apparatus 1 includes locking mechanism 48 for locking seat pad 29 to a predetermined angle, such as 0.0. By locking seat pad 29 to the predetermined angle, movement of the seat pad during mounting and dismounting of apparatus 1 is reduced.

Figure 7:
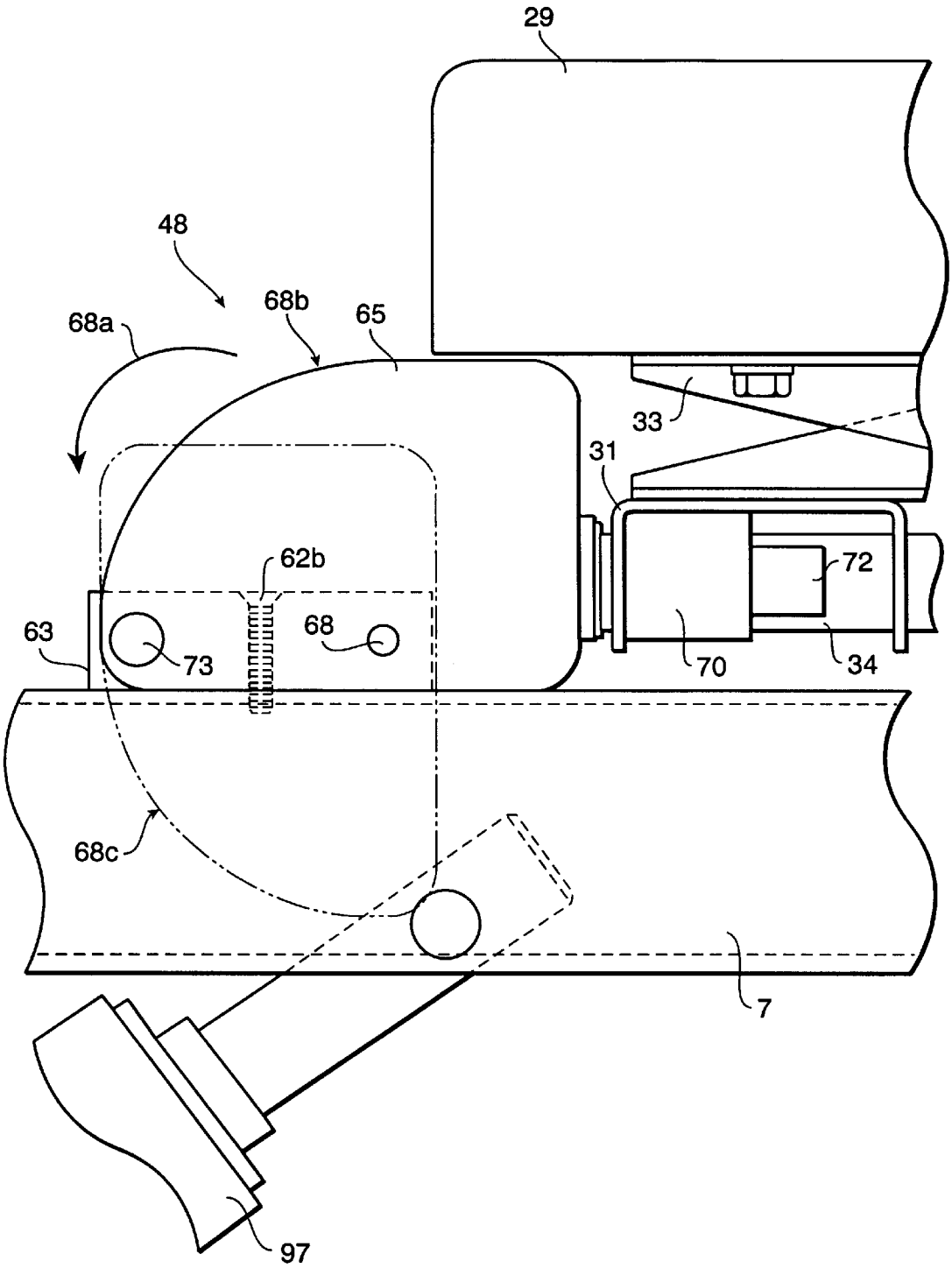
FIG. 7 shows a side view of a seat pad locking mechanism used in the apparatus of FIG. 1.
Figure 8:
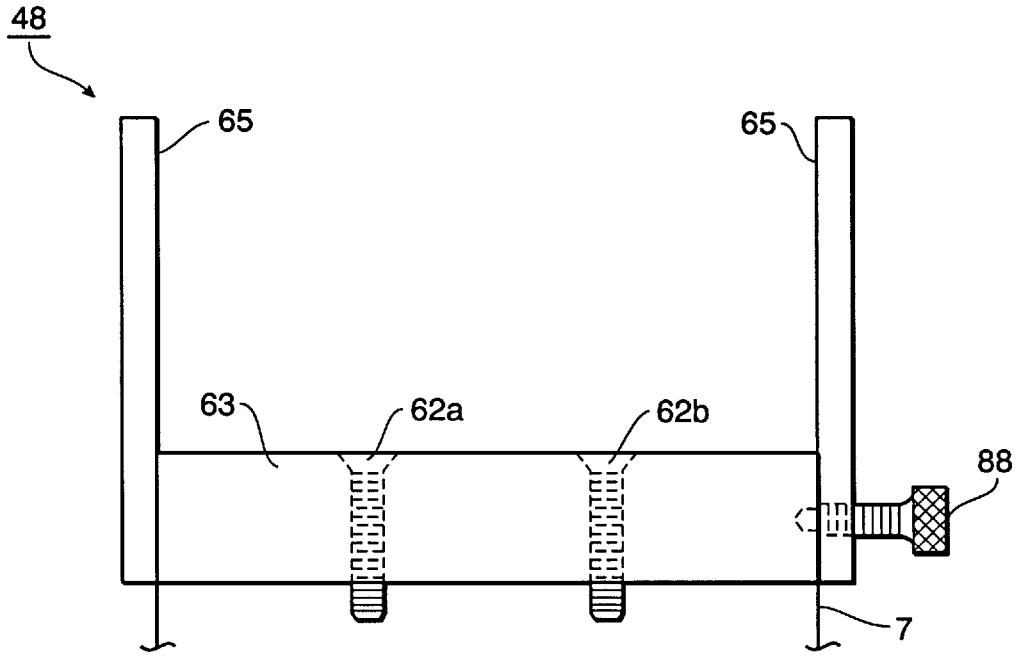
FIG. 8 shows a front view of the locking mechanism of FIG. 7.

Close-up front and side views of locking mechanism 48 are shown in FIGS. 7 and 8, respectively. As shown in those figures, locking mechanism is attached to support bar 7 via screws 62*a* and 62*b* in fastening plate 63. As shown, locking mechanism 48 contains two wedge-shaped plates 65, one on each side of support bar 7. Wedge-shaped plates 65 are interconnected to rotate in unison throughout a range of angles about pivot point 68. Locking mechanism 48 also includes a hole 73 in at least one of wedge-shaped plates 65, which aligns with a hole in fastening plate 63 and through which a pin, such as spring-loaded pin 88 (shown in FIG. 8), is inserted in order to prevent rotation of locking mechanism 48. In this manner, wedge-shaped plates 65 can be held in place at a predetermined angle, and thus hold seat pad 29 at the predetermined angle. When the pin is removed, locking mechanism 48 is free to rotate about pivot point 68 along arrow 68*a*, shown in FIG. 7, from locking position 68*b* to unlocking position 68*c*, thereby freeing seat pad 29 for rotation.

Alternatively, locking mechanism can comprise a slidable metal fitting having a slot therein for receiving a finger extending downwardly from rotation cylinder 34. In such an case, the metal fitting slides into a locking position, where the finger is inserted into the metal fitting so as to prevent rotation cylinder 34 from rotating, and into an unlocking position, where the finger is not inserted into the metal fitting, which allows rotation cylinder 34 to rotate freely.

Turning to the structure of seat pad 29, seat pad 29 preferably is made from the same material, i.e., vinyl, as back pad 24 and is likewise cushioned enough to provide comfort without sacrificing support. As shown in FIG. 1, however, seat pad 29 is preferably not flat like the preferred embodiment of back pad 24. Rather, as shown, seat pad 29 includes raised edges 47. Raised edges 47 are provided to reduce the chances that a person using apparatus 1 will fall off when seat pad 29 is rotated. For this reason, raised edges 47 should be high enough to reduce the chances of a person falling off apparatus 1, yet low enough so as not to interfere with that person's operation of the handles described below.

Seat pad 29 can also be provided with seat belt 49, shown in FIG. 1. Seat belt 49, when used correctly, both prevents a user from falling off apparatus 1 during angular rotation of seat pad 29, and also limits motion (e.g., sliding) of the user's pelvis/hips on seat pad 29 during operation of apparatus 1.

Figure 9:
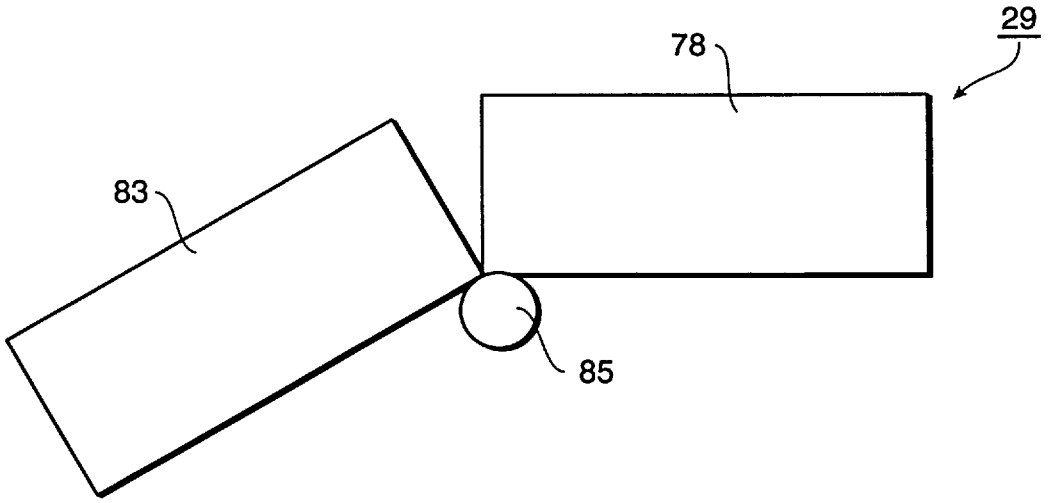
FIG. 9 shows an example of a seat pad having hinged portions.

In some embodiments, seat pad 29 can be separated into plural portions, such as upper portion 78 and lower portion 83, shown in FIG. 9. These portions can be connected via a settable hinge, such as friction hinge 85, and set to different angles relative to one another. Using such a configuration, it is possible to accommodate differing spine curvatures.

Preferably, seat pad 29 is not movable relative to back pad 24 along longitudinal axis 9. However, apparatus 1 could be constructed so as to provide for mobility of seat pad 29 along support 7. Such mobility could be provided by the means described above with respect to back pad 24.

As shown in FIGS. 1 to 4, apparatus 1 also includes handles 50 and 51, one on each side of apparatus 1, for controlling the above-described angular motion of seat pad 29. The positioning of grips, such as grip 58, on the handles shown in FIG. 3 is intended to facilitate their operation by a user reclining horizontally on apparatus 1. Accordingly, handles 50 and 51 are positioned on either side of seat pad 29 in preferred embodiments of apparatus 1. As shown in the figures, handles 50 and 51 can include outer handles 53 and 55, respectively, which can be used to activate handles 50 and 51. These outer handles are provided to accommodate differing arm lengths and should be positioned relative to handles 50 and 51 so as not to interfere with their use.

In the embodiment shown, each of handles 50 and 51 is L-shaped and comprises a base and a lever, such as base 52 and lever 54 of handle 50 (see FIGS. 1 to 4). It is noted however, that although the handles in the embodiment are L-shaped, they need not be shaped exactly in this manner. Rather, any shape which will accomplish the function of the handles described below will do. It is further noted that the construction of handles 50 and 51 is identical. Accordingly, only a description of handle 50 will be provided.

In this regard, base 52 of handle 50 is fixed to lever 54 at intersection point 56 so as to prevent movement of base 52 relative to lever 54. Lever 54 extends upwardly from base 52, as shown in FIGS. 1 to 4. However, as show in FIGS. 3 and 4, lever 54 does not extend directly upward from base 52. Rather, lever 54 curves outwardly, as shown by curved portion 57 of lever 54, during its upward extension. This curvature is provided so as to ensure that handle 50 does not interfere with the motion of seat pad 29 and vice versa. Lever 54 may terminate in grip 58, which a user can grab onto in order to activate handle 50. In preferred embodiments, grip 58 can be plastic, rubber or any other such material, and is settable along the length of lever 54.

Base 52 of handle 50 also includes finger 59, to which rotatable arm 60 (described below) is coupled. More specifically, finger 59, shown in FIGS. 3 and 4, extends inwardly from base 52 towards support 7 at roughly a 90° angle. Finger 59 is not movable relative to handle 50.

Handles 50 and 51 are connected to seat pad 29 via couplings 61 and 62, which are preferably mechanical and are shown in FIGS. 2 to 4. Couplings 61 and 62 include, among other things, rotatable arms 60 and 64, respectively, which mechanically couple each of handles 50 and 51 to opposite sides of seat pad 29. It is noted that the mechanical coupling of the rotatable arms to seat pad 29 is identical for each of handles 50 and 51. Accordingly, only a description of coupling 61 will be provided. In this regard, rotatable arm 60 is comprised of a body 66 and two heads 67 and 69. Body 66 is not movable relative to heads 67 and 69, nor is body 66 extendible. Each head 67 and 69 has a throughbore therein, for coupling to a handle and to seat pad 29. As shown in the figures, heads 67 and 69 are rotated roughly 90° with respect to each other so as to provide for proper couplings to seat pad 29 and finger 59 of handle 50, as described in more detail below.

Rotatable arm 60 is rotatably coupled to finger 59 of handle 60, so that rotatable arm 60 is rotatable about finger 59. In a preferred embodiment at the invention, this coupling is achieved by inserting finger 59 through the throughbore in head 69. In such a case, an end cap (not shown) may also be inserted at the end of finger 59 so as to ensure that rotatable arm 60 does not fall off finger 59 during use.

The underside of plate 31 includes tabs 70 and 71, one on each side of support 7. A member 72, such as bolt, is affixed to each of these tabs (see also FIGS. 16 and 17). Member 72 is inserted into the throughbore of head 67 of rotatable arm 60 so that rotatable arm 60 is rotatable about member 72. An identical arrangement is provided for rotatable arm 64.

The foregoing couplings provide for the rotation of seat pad 29 around longitudinal axis 9, in response to reciprocal back-and-forth motion of handles 50 and 51 by a user, as described in more detail below.

As shown in FIGS. 3 and 4, handles 50 and 51 are coupled to connector 74, which can be a rod or the like, such that handles 50 and 51 are rotatable about connector 74. Connector 74 runs between the two handles and itself does not move or rotate. The rotation of handles 50 and 51 about connector 74 provide for reciprocal back-and-forth motion of handles 50 and 51, as described in more detail below.

Connector 74 is preferably fixed to frame extension 76, also shown in FIGS. 3 and 4, which extends downwardly from support 7. Preferably, connector 74 is inserted into frame extension 76 and welded thereto, or affixed thereto via other means, at points 77 and 79.

Resistance devices can also be provided between connector 74 and each of handles 50 and 51 to provide additional resistance to the reciprocal back-and-forth motion of handles 50 and 51. Such additional resistance promotes muscle development in many of the major muscle groups of the user's body, such as the arms (particularly in the triceps and biceps areas), the abdominals, the back, etc. In a preferred embodiment of apparatus 1, the resistance device is variable resistance air cylinder 80 coupled to one side of plate 32 and coupled to connector 74, as shown in FIGS. 3 and 4. Friction pads can instead be used. Variable resistance air cylinder 80 includes piston 81, which is coupled to the underside of plate 32, and casing 82, which is coupled to connector 74 via connecting piece 84. Since connector 74 does not move, and since seat pad 29 rotates, this configuration provides for movement of piston 81 within casing 82, as described below in more detail.

Variable resistance air cylinder 80 is preferably adjustable so as to provide different levels of resistance for different users. Alternatively, plural variable resistance air cylinders could be added to apparatus 1 to provide additional resistance.

Also provided along support 7 are leg rest 86 and foot rest 87 (see FIG. 2). Foot rest 87 and leg rest 86 are positioned on support 7 so as to provide support for a user's feet and legs, respectively. Both foot rest 87 and leg rest 86 can be cushioned or uncushioned, and the figures show leg rest 86 cushioned and foot rest 87 uncushioned. In the preferred embodiment of the invention, foot rest 87 and leg rest 86 are not adjustable along support 7 relative to seat pad 29; however, leg rest 86 and/or foot rest 87 can be made adjustable along longitudinal axis 9 in the same manner as back pad 24. In this regard, shelf 93, shown in FIG. 2, of foot rest 87 can also be made adjustable along foot rest 87 in a similar manner.

Figure 10:
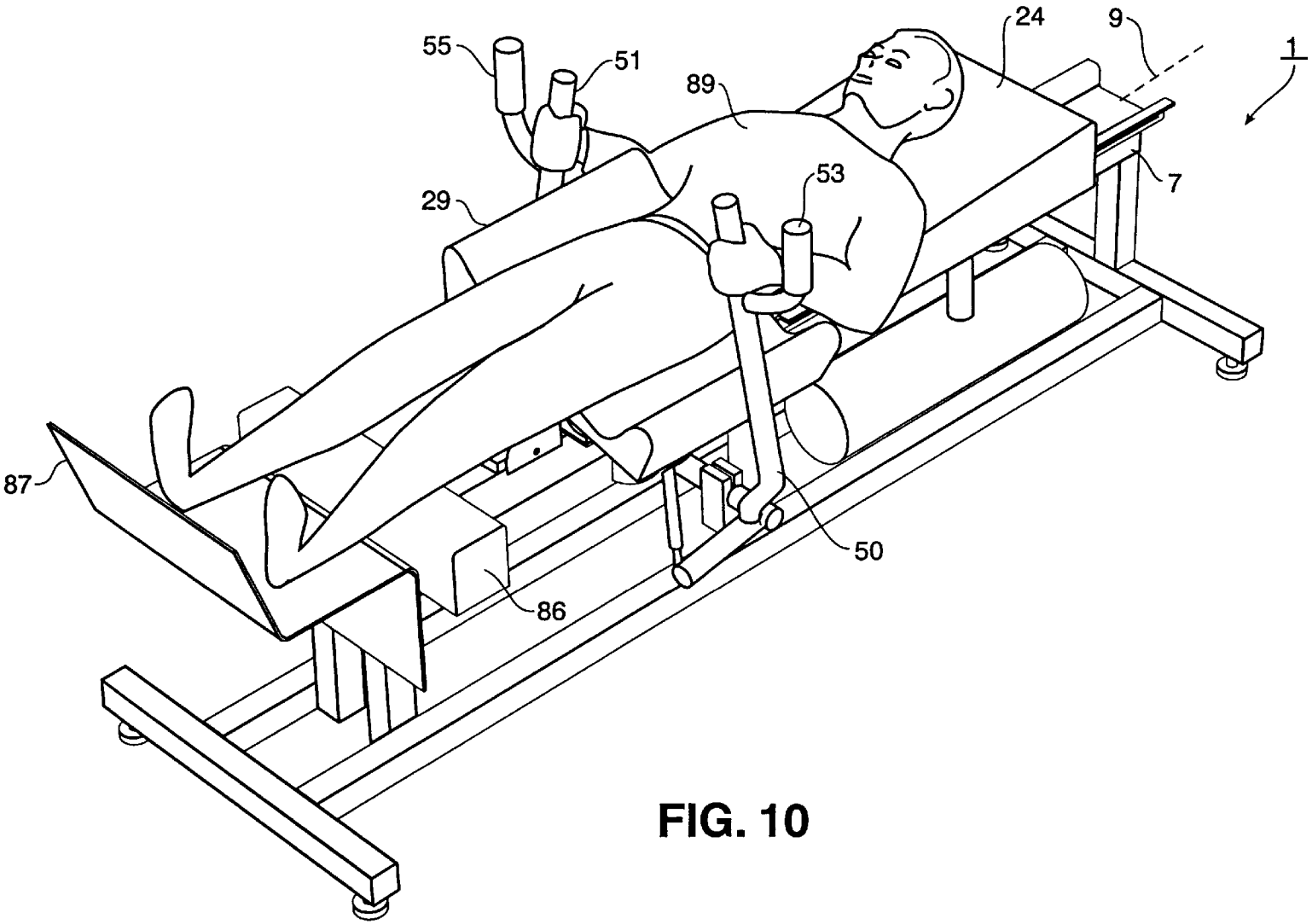
FIG. 10 shows a perspective view of a user operating the apparatus of FIG. 1.

In operation, reciprocal back-and-forth motion of handles 50 and 51 controls angular rotation of seat pad 29 around support 7 (as noted above, additional control over the angular motion can be provided by the user himself through self-generated back rotation). FIG. 10 shows an example of user 89 reclining on apparatus 1 such that his pelvis is on seat pad 29 and his back is on back pad 24. As shown, the user's arms are thus in position to activate handles 50 and 51.

In operation and referring to FIG. 10, user 89 grasps handles 50 and 51 and moves the handles substantially parallel to longitudinal axis 9 in a reciprocal back-and-forth motion. By moving handles 50 and 51 in this manner, as noted, seat pad 29 is caused to rotate about support 7. As a result, the user's pelvis on seat pad 29 rotates along with seat pad 29. Meanwhile, the portion of the user's back resting on back pad 24 remains substantially immobile relative to the user's pelvis.

Figure 11:
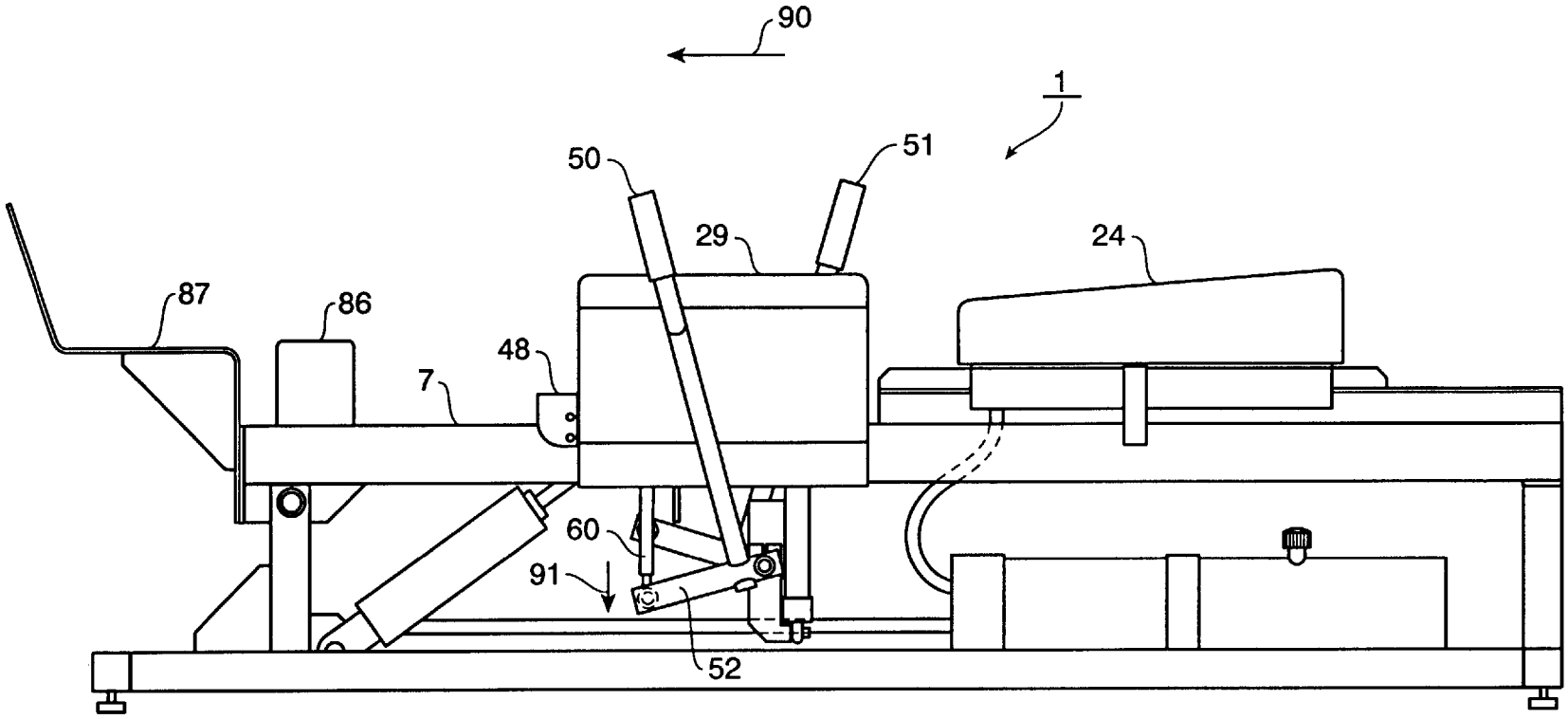
FIG. 11 shows a side view of the apparatus of FIG. 1 in which the handle in the foreground has been operated in the forward position.

FIGS. 3 and 11, respectively, show back and side views of apparatus 1 during operation of handle 50 in the forward direction, i.e., the direction of arrow 90 shown in FIG. 11. This operation causes base 52 of handle 50 to move relatively downward, in the direction of arrow 91. This, in turn, causes rotatable arm 60 also to move downward. Downward motion of rotatable arm 60 causes the side of seat pad 29 to which rotatable arm 60 is coupled also to move downward. Since head 67 of rotatable arm 60 is rotatable about member 72, and since head 69 of rotatable arm 60 is rotatable about finger 69, downward movement of seat pad 60 is not hindered. Thus, the end result of a forward motion of handle 50 is for one side of seat pad 29 to rotate downward about support 7 towards handle 50.

Figure 12:
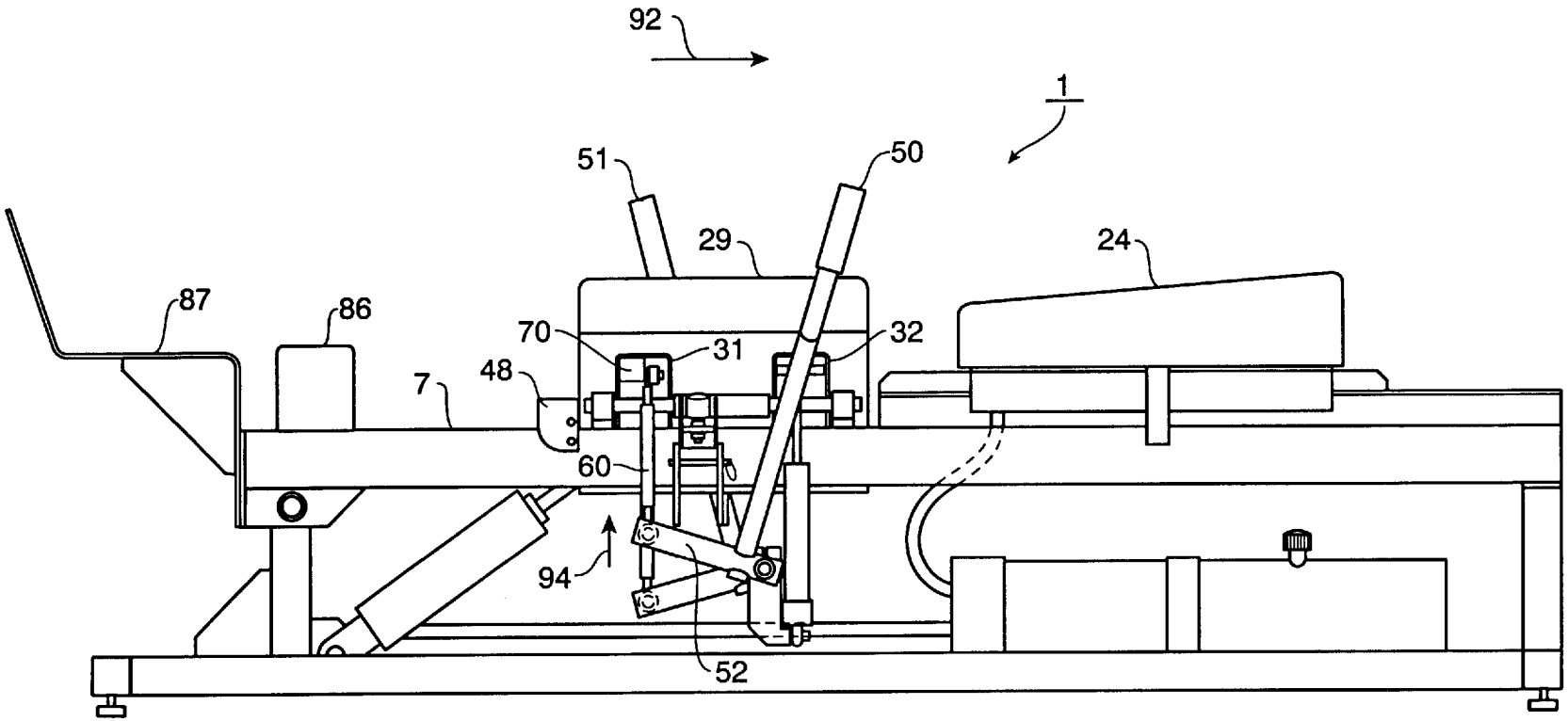
FIG. 12 shows a side view of the apparatus of FIG. 1 in which the handle in the foreground has been operated in the backward position.

FIGS. 4 and 12 respectively show back and side views during operation of handle 50 in the backward direction, i.e., the direction of arrow 92 shown in FIG. 12. This operation causes base 52 of handle 50 to move relatively upward, in the direction of arrow 94. This, in turn, causes rotatable arm 60 also to move upward. As was the case above, since rotatable arm 60 is coupled to one side of seat pad 29, the end result of the foregoing is for that side of seat pad 29 to rotate upward away from handle 50.

It is noted that the foregoing operation of handles 50 and 51 is reciprocal in the sense that the same motion cannot be applied to both handles at the same time. That is, as is made clear by the foregoing description, as one handle is actively moved forward, seat pad 29 rotates towards that handle. This causes seat pad 29 to rotate away from the other handle, thus passively moving the other handle into the backward position. Springs or the like (not shown) can be added to apparatus 1 to facilitate this movement.

Accordingly, by activating handles 50 and 51, as shown in FIG. 3, 4, 11 and 12, a user can always control the degree of pelvic rotation provided by apparatus 1 (up to, of course, the maximum angle of rotation set by stops 41 and 42), as well as the speed and force of that pelvic rotation.

As noted, the pelvic motion provided by the rotation of seat pad 29 is similar to that of swimming in the sense that it causes the user's back muscles, joints, bones, etc. to rotate in a manner similar to that of swimming. This has a therapeutic effect on the user's back and, in many cases, relieves lower back pain. Additionally, the apparatus can be used by people without lower back pain as a way of reducing the possibility of such pain in the future, or as merely a form of exercise.

Returning to FIGS. 3 and 4, as seat pad 29 of apparatus 1 rotates, piston 81 of variable resistance air cylinder 80 moves up and down inside of casing 82. As a result, additional force is required to provide the requisite back-and-forth motion needed to rotate seat pad 29 around longitudinal axis 9. This resistance promotes muscle development, as noted.

In this regard, it is noted that while FIG. 10 depicts user 89 lying face-up, apparatus 1 can be operated with a user lying face-down. In such a case, the rotary muscles of the user's back, in addition to the user's arm muscles, drive the apparatus. As such, the additional resistance provided by variable resistance air cylinder 80 also promotes the development of the rotary back muscles.

Figure 13:
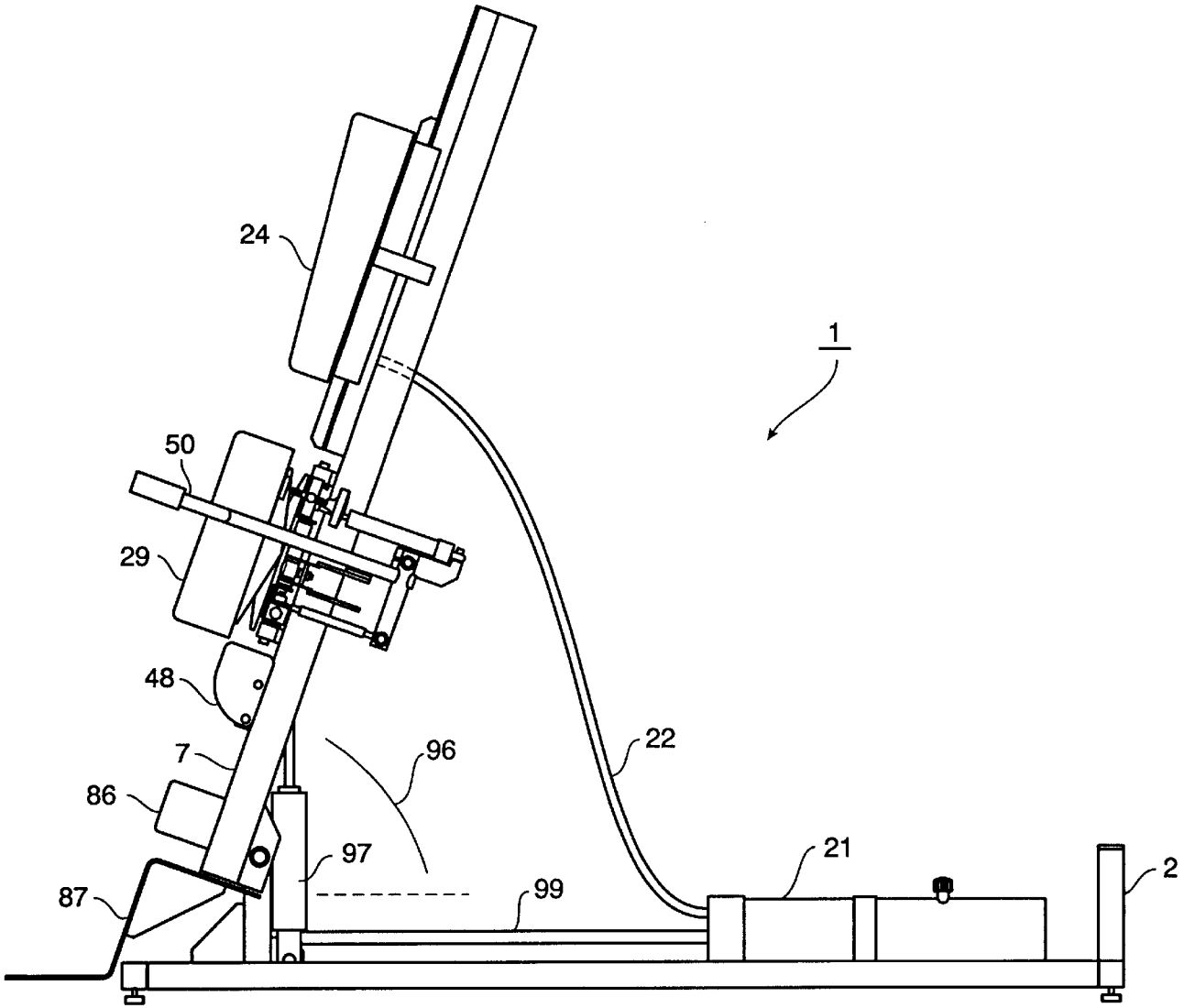
FIG. 13 shows a side view of the apparatus of FIG. 1 in which its linear support is inclined.

FIG. 13 depicts an additional feature of apparatus 1. More specifically, as noted above, people suffering from lower back pain have difficulty lying down and getting up from horizontal surfaces. Accordingly, support 7 of apparatus 1, and all of the elements disposed thereon, can incline at an angle relative to base 2 so as to facilitate use of the apparatus by those who have difficulty bending over. That is, apparatus 1 includes a controller, which is used to incline apparatus 1 along a range of angles, such as between a horizontal inclination angle, e.g., 0° or slightly tilted, and an upright inclination angle closer to a vertical position, e.g., angle 96 of FIG. 13. In the preferred embodiment of the invention, upright inclination angle 96 is 53°; however, any angle can be set.

In the preferred embodiment of the invention, the foregoing controller is preferably hydraulic, such as hydraulic controller 97, shown in FIG. 13 and is activated by hand or foot controls (not shown). In such a case, hydraulic tank 21 and hydraulic line 99 also must be provided to supply hydraulic controller 97 with hydraulic fluid. It should be noted, however, that the foregoing controller could be electric or mechanical.

As shown in FIG. 13, when apparatus 1 is inclined at the upright inclination angle, a user can easily mount the apparatus. Thereafter, the user can lower the apparatus back to 0° using hydraulic controller 97 and operate the apparatus in a horizontal position. When finished using the apparatus, the user can raise the apparatus back to angle 96 (or whatever angle is desired) and dismount the apparatus easily. As a result, the need to bend over to mount and dismount the apparatus is decreased. In embodiments of the invention where foot rest 87 is adjustable, foot rest 87 can be adjusted at this point to facilitate the mounting and dismounting of the apparatus even further.

It is noted that hydraulic lines 22 and 99 must be sufficiently long to accommodate the foregoing angular motion of support 7, as shown in FIG. 13.

Figure 14:
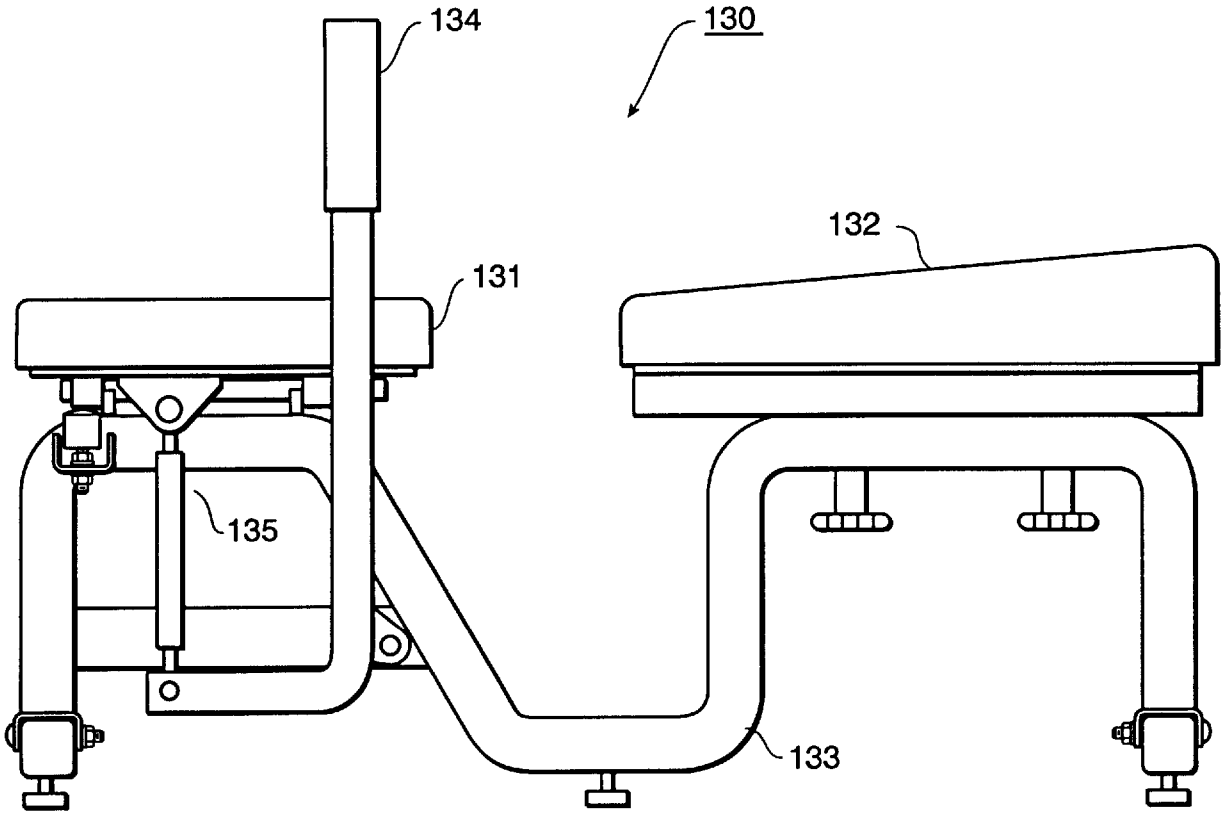
FIG. 14 shows an alternative embodiment of the present invention.

FIG. 14 shows a modified version of the above embodiment of the present invention. As shown, apparatus 130 includes seat pad 131, back pad 132, support 133, handles 134 (one on each side of apparatus 130) and mechanical coupling 135. In this version, mechanical coupling 135 operates identically to couplings 60 and 61 described above to rotate seat pad 131 about a longitudinal axis. Accordingly, a detailed description thereof is omitted for the sake of brevity.

As was the case above, in operation, a user reclines on apparatus 130 with his back on back pad 132 and his pelvis on seat pad 131. Thereafter, the user operates handles 134 in reciprocal back-and-forth motion so as to cause angular rotation of seat pad 131 about a longitudinal axis defined by support 133.

Second Embodiment

Figure 15:
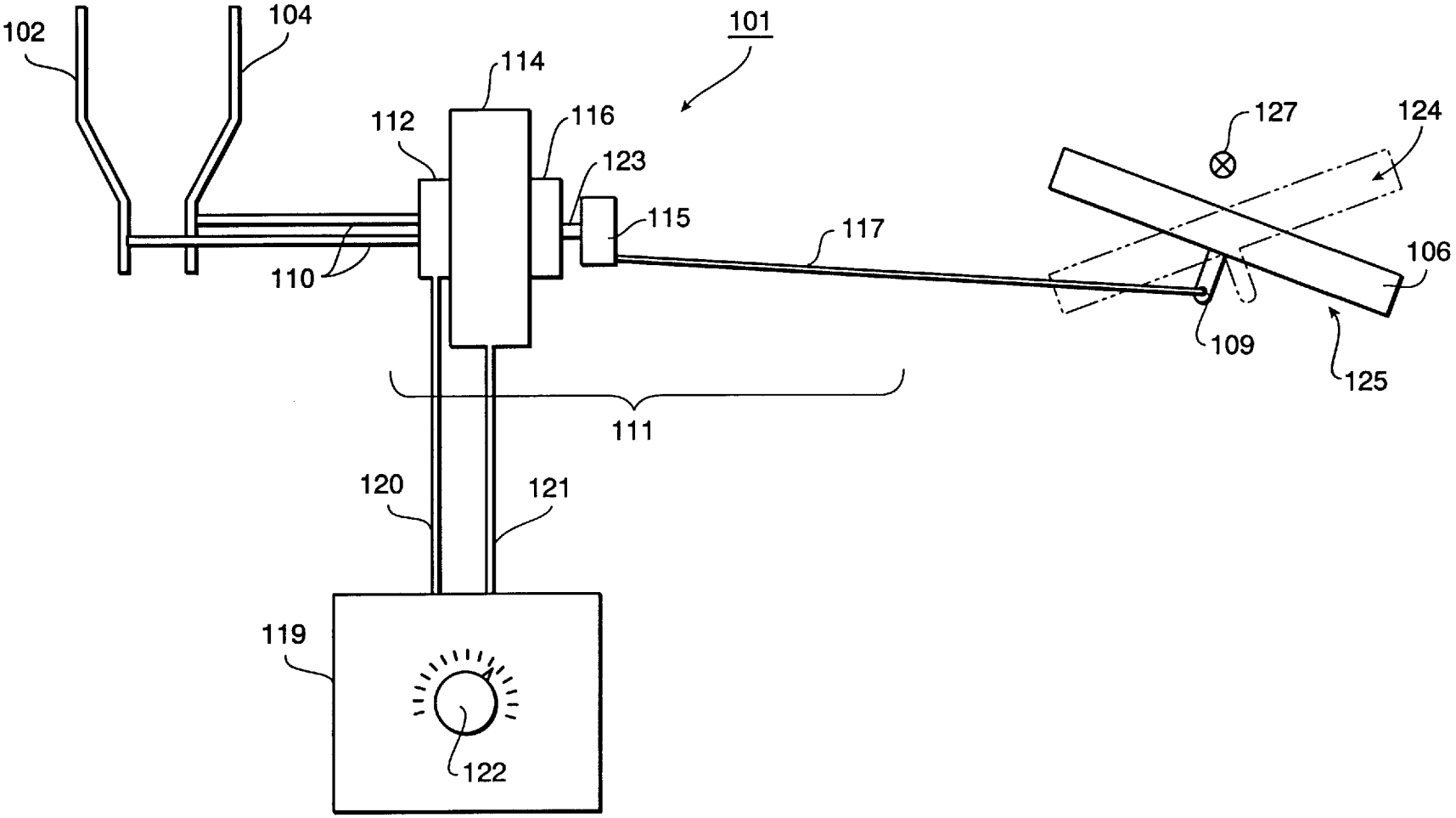
FIG. 15 shows an alternative embodiment of the present invention which monitors a rate of rotation of the seat pad and controls the rate of rotation of the seat pad based on the monitored rate.

FIG. 15 shows an alternative embodiment of the above invention which includes a rate limiting mechanism for controlling the rate of rotation of a seat pad so as to reduce injuries caused by overly-rapid rotation of the seat pad. For the purposes of this description, the apparatus of this embodiment is assumed to have a structure identical to that of apparatus 1 above except for (1) coupling 101 between seat pad 106 and handles 102 and 104 and (2) leg 109 extending from seat pad 106. Accordingly, for the sake of brevity and clarity, only these features, both of which are described in detail below, are shown in FIG. 15.

In brief, coupling 101 includes a monitor for monitoring a rate of rotation of seat pad 106 in order to determine whether the rate of rotation exceeds a preset limit. A rotation controller controls angular rotation of seat pad 106 to the preset limit in a case that the monitor determines that the rate of rotation of seat pad 106 exceeds the preset limit. By limiting the seat pad's rotation rate in this manner, injuries to users caused by overly-rapid rotation of seat pad 106 can be reduced.

Thus, as shown in FIG. 15, coupling 101 includes (1) handle rods 110, (2) rotation controller 111 comprising clutch 112, fly wheel assembly 114, motion converter 115, gear reduction box 116, rotatable member 123, and linking rod 117, (3) monitor and controller 119 connected to rotation controller 111 via signal wires 121 and signal and control wires 120, and (4) adjusting mechanism 122. Each of these features will be described in more detail below.

As noted, handles 102 and 104 operate in reciprocal back-and-forth motion identical to handles 50 and 51 described above. This reciprocal back-and-forth motion of handles 102 and 104 is transmitted to rotation controller 111, specifically to clutch 112 and fly wheel assembly 114, which are connected to handles 102 and 104, via handle rods 110.

The operation of clutch 112 will be described in detail below. With respect to fly wheel assembly 114, fly wheel assembly 114 spins in accordance with the back-and-forth motion of handles 102 and 104 in order to control rotation of seat pad 106. Gear reduction box 116 steps-down the rate of spinning of fly wheel assembly 114 to a desired level, and causes rotatable member 123 to spin at the desired level. Thereafter, motion converter 115 converts the rotation of rotatable member 123 to a push-pull motion.

As shown in FIG. 15, motion converter 115 is connected to linking rod 117 which, in turn, is connected to leg 109 of seat pad 106. Thus, the push-pull motion of linking rod 117 causes leg 109 of seat pad 106 to move from position 124 shown in the figure to position 125 also shown in the figure. This motion, causes seat pad 106 to rotate about a longitudinal axis 127 which faces out of the page.

Monitor and controller 119 monitors the spinning rate of fly wheel assembly 114 via signal wires 121 in order to determine the rate of rotation of seat pad 106 (which it can do since the spinning of fly wheel assembly 114 ultimately controls the rotation of seat pad 106). When monitor and controller 119 determines that the rate of rotation of seat pad 106 has exceeded a preset limit, monitor and controller engages clutch 112 via signal and control wires 121. This preset limit can either be set within monitor and controller 119 or it can be set as desired by a user. To this end, in preferred embodiments of the invention, monitor and controller 119 includes adjusting mechanism 122 for adjusting the preset limit.

Once clutch 112 has been engaged via signal and control wires 121, clutch 112 separates handles 102 and 104 from fly wheel assembly 114. As a result, back-and-forth motion of handles 102 and 104 no longer affects the spinning of flywheel 114. Fly wheel assembly 114 then continues to spin in the manner described above so as to cause rotation of seat pad 106. During this time, monitor and controller 119 continues to monitor fly wheel assembly 114 in order to determine when the rate of rotation of seat pad 106 goes below the preset limit. Once monitor and controller 119 determines that the rate of rotation of seat pad 106 has fallen below the preset limit, monitor and controller 119 disengages clutch 112 causing the back-and-forth motion of handles 102 and 104 to control spinning of fly wheel assembly 114 once again. Thereafter, the apparatus operates as described above.

The invention has been described with respect to particular illustrative embodiments. It is to be understood that the invention is not limited to the above-described embodiments and that various changes and modifications may be made by those of ordinary skill in the art without departing from the spirit and scope of the invention.

What is claimed is:

1. An apparatus for manipulating a user's back while supporting the user's back and hips, said apparatus comprising:

one or more pads arranged along a longitudinal axis, the one or more pads for supporting the user's back and hips and being rotatable around the longitudinal axis;

a pair of upwardly extending handles for grasping by the user, one on each side of the apparatus; and a pair of substantially identical couplings, one between each of the pair of handles and at least one of the one or more pads, each coupling comprising a rotatable arm having a first pivotable joint coupled to one of said pads and a second pivotable joint coupled to a corresponding one of said handles, the couplings for coupling reciprocal back-and-forth longitudinal motion of the handles to at least one of said pads so as to control rotation of said at least one of said pads around the longitudinal axis.

2. An apparatus for manipulating a user's back while supporting the user's back and hips, said apparatus comprising:

first and second pads arranged along a longitudinal axis, the first pad for supporting the user's back and the second pad for supporting the users hips, the first and second pads being mutually rotatable around the longitudinal axis;

a pair of upwardly extending handles for grasping by the user, one on each side of the apparatus; and a pair of substantially identical couplings, one between each of the pair of handles and at least one of the first pad and the second pad, each coupling comprising a rotatable arm having a first pivotable joint coupled to one of said pads and a second pivotable joint coupled to a corresponding one of said handles, the couplings for coupling reciprocal back-and-forth longitudinal motion of the handles to at least one of said pads so as to control mutual rotation of the first pad and the second pad around the longitudinal axis.

3. An apparatus according to claim 2, wherein at least one rotatable arm moves downward in response to a forward motion of the corresponding handle so as to cause the second pad to rotate downward, and moves upward in response to a backward motion of the corresponding handle so as to cause the second pad to rotate upward.

4. An apparatus according to claim 3, wherein each handle comprises an upwardly extending lever for manual activation, a base which extends outwardly from a bottom of the lever, and a finger which extends inwardly from an end of the base;

wherein each rotatable arm includes a head at each end thereof, each head having a throughbore;

wherein each coupling further comprises a plate affixed to an underside of the second pad, the plate having a member extending outwardly therefrom on each side of the longitudinal axis; and wherein each rotatable arm is coupled between the plate and a handle by (1) inserting a head of the rotatable arm onto the member extending from the plate and (2) placing the other head of the rotatable arm on a finger on the rotatable arm.

5. An apparatus according to claim 4, wherein the head of the rotatable arm inserted onto the member is rotatable around the member, and wherein the head of the rotatable arm inserted onto the finger is rotatable around the finger.

6. An apparatus according to claim 2, wherein each of the pair of handles is rotatable about a connecting means which connects the pair of handles.

7. An apparatus according to claim 2, further comprising a resistance device mechanically coupled to the second pad for providing resistance to the reciprocal back-and-forth motion of the pair of handles.

8. An apparatus according to claim 7, wherein the resistance device comprises an adjustable resistance device which is adjustable to provide different resistances during the reciprocal back-and-forth motion of the pair of handles.

9. An apparatus according to claim 8, wherein the resistance device comprises a variable resistance air cylinder coupled between one side of the second pad and a connector which holds the pair of handles so as to provide resistance to the rotation of the second pad around the longitudinal axis.

10. An apparatus according to claim 2, further comprising one or more resistance device(s) coupled to each of the pair of handles for providing resistance to the reciprocal back-and-forth motion of the pair of handles.

11. An apparatus according to claim 2, wherein at least one of the first pad and the second pad comprises an adjustable pad which is adjustable such that the first pad and the second pad can be positioned at different points along the longitudinal axis relative to one another.

12. An apparatus according to claim 2, further comprising one or more mechanical stops for limiting angular motion of the second pad around the longitudinal axis.

13. An apparatus according to claim 12, wherein the one or more mechanical stops comprise settable mechanical stops which are settable to limit the angular motion of the second pad to one of plural angles.

14. An apparatus according to claim 13, wherein each mechanical stop comprises two metal plates, a pin and a stopper, the stopper being rotatable through the metal plates, and the metal plates having corresponding holes for receiving the pin; and wherein when the pin is received in corresponding holes in the metal plates, the stopper is prevented from rotating.

15. An apparatus according to claim 2, wherein the longitudinal axis is defined by a linear support, and wherein the apparatus further comprises a controlling mechanism for inclining the linear support along a range of angles.

16. An apparatus according to claim 2, further comprising a locking mechanism for locking the second pad at a predetermined angle relative to the longitudinal axis.

17. An apparatus according to claim 16, wherein the locking mechanism comprises:

a fastening plate for fastening the locking mechanism to the apparatus along the longitudinal axis, the fastening plate having a hole therethrough;

plural plates rotatably mounted below the second pad and rotatable about a pivot point relative to the second pad, the plural plates (1) being interconnected to rotate in unison and (2) being rotatable through the fastening plate, at least one of the plural plates having a hole therethrough which aligns with the hole in the fastening plate; and a pin for inserting into the hole of the at least one plate and into the hole of the fastening plate for holding the plural plates at a predetermined angle relative to the second pad.

18. An apparatus according to claim 2, wherein the second pad comprises upper and lower portions defined by a lateral axis which is roughly perpendicular to the longitudinal axis; and wherein the upper and lower portions are interconnected via a hinge.

19. An apparatus according to claim 18, wherein the lower portion of the second pad comprises a settable portion which is settable to various angles relative to the upper portion of the second pad along the lateral axis.

20. An apparatus according to claim 2, wherein the second pad is settable to one of various pitch angles along a lateral axis which is roughly perpendicular to the longitudinal axis; and wherein the apparatus further comprises an adjusting mechanism for adjusting the pitch angle.

21. An apparatus according to claim 2, further comprising at least one stationary handle which extends from the first pad.

22. An apparatus according to claim 2, further comprising a seat belt on the second pad for holding a user's hips in place during rotation of the second pad.

23. An apparatus according to claim 2, wherein the coupling comprises:

a monitor for monitoring a rate of rotation of the second pad in order to determine whether the rate of rotation exceeds a preset limit; and a rotation controller for controlling the rate of rotation of the second pad to the preset limit in a case that the monitor determines that the rate of rotation of the second pad exceeds the preset limit.

24. An apparatus according to claim 23, further comprising adjusting means for adjusting the preset limit of the rate of rotation of the second pad.

25. An apparatus according to claim 23, wherein the rotation controller comprises a fly wheel assembly, connected between the pair of handles and the second pad, which spins in accordance with the back-and-forth motion of the pair of handles in order to rotate the second pad; and wherein the monitor monitors the fly wheel assembly in order to determine whether rate of rotation of the second pad exceeds the preset limit.

26. An apparatus according to claim 25, wherein the rotation controller further comprises:

a clutch, connected between the pair of handles and the fly wheel assembly, which engages in a case where the rate of rotation of the second pad exceeds the preset limit so as to disconnect the pair of handles from the fly wheel assembly, and which disengages in a case where the rate of rotation of the second pad is less than or equal to the preset limit so as to connect the pair of handles to the fly wheel assembly;

a gear reduction box which steps-down a rate of spinning of the fly wheel assembly;

a rotatable member, which rotates at the rate of spinning stepped-down by the gear reduction box;

a motion converter which converts rotation of the rotatable member to a push-pull motion; and a linking rod, coupled between the motion converter and the second pad, which rotates the second pad in accordance with the push-pull motion of the motion converter;

wherein the monitor causes the clutch to engage and to disengage based on a monitored rate of rotation of the second pad.

27. An apparatus for manipulating a user's back while supporting the user's back and hips, said apparatus comprising:

a linear support defining a longitudinal axis;

a seat pad disposed along the linear support at a position corresponding to the user's hips, the seat pad (1) supporting the user's hips, (2) being rotatable around the longitudinal axis, and (3) having an attached seat belt for holding a user on the seat pad;

a pair of upwardly extending handles for grasping by the user, one on each side of the seat pad, which are mechanically coupled to the seat pad and which are movable in reciprocal back-and-forth motion to control rotation of the seat pad around the longitudinal axis;

a pair of substantially identical couplings which couple each handle to one side of the seat pad so that the seat pad rotates downward in response to a forward motion of a handle and rotates upward in response to a backward motion of the handle, each coupling comprising a rotatable arm having a first pivotable joint coupled to said seat pad and a second pivotable joint coupled to a corresponding one of said handles;

a resistance device coupled to the seat pad for providing resistance to reciprocal back-and-forth motion of the handles;

two mechanical stops, one on each side of the apparatus, for limiting rotation of the seat pad, the mechanical stops each having plural settings for adjusting a maximum angle of rotation of the seat pad; and a back pad coupled to the linear support, which is adjustable along the longitudinal axis.

28. An apparatus according to claim 27, further comprising a controller for controlling inclination of the linear support along a range of angles.

29. An apparatus according to claim 28, wherein each handle comprises an upwardly extending lever for manual activation, a base which extends outwardly from a bottom of the lever, and a finger which extends inwardly from an end of the base;

wherein each coupling comprises (1) a plate affixed to an underside of the seat pad, the plate having a member extending outwardly therefrom, and (2) a rotatable arm coupled between the plate and a finger of a handle, each rotatable arm including a head at each end thereof, each head having a throughbore; and wherein each rotatable arm is coupled between the plate and a handle by (1) inserting a head of the rotatable arm onto the member extending from the plate and (2) placing the other head of the rotatable arm on a finger on the rotatable arm.

30. An apparatus according to claim 29, wherein the head of the rotatable arm inserted onto the member is rotatable around the member, and wherein the head of the rotatable arm inserted onto the finger is rotatable around the finger.

* * * * *